US009910406B2

(12) United States Patent
Horii et al.

(10) Patent No.: US 9,910,406 B2
(45) Date of Patent: Mar. 6, 2018

(54) IMAGE FORMING APPARATUS AND METHOD

(71) Applicant: FUJI XEROX CO., LTD., Tokyo (JP)

(72) Inventors: Kiyohito Horii, Ebina (JP); Atsushi Funada, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/257,334

(22) Filed: Sep. 6, 2016

(65) Prior Publication Data

US 2017/0248866 A1 Aug. 31, 2017

(30) Foreign Application Priority Data

Feb. 25, 2016 (JP) ..... 2016-034201

(51) Int. Cl.
*G03G 21/18* (2006.01)
*G03G 21/16* (2006.01)

(52) U.S. Cl.
CPC ..... *G03G 21/1842* (2013.01); *G03G 21/1671* (2013.01); *G03G 21/1676* (2013.01)

(58) Field of Classification Search
None
See application file for complete search history.

(56) References Cited

U.S. PATENT DOCUMENTS

2007/0166070 A1* 7/2007 Sato ..... G03G 21/1821 399/90
2009/0290903 A1* 11/2009 Horikawa ..... G03G 21/185 399/111
2009/0297211 A1 12/2009 Kanno et al.
2010/0142994 A1 6/2010 Kinoshita
2011/0103829 A1 5/2011 Kanno et al.
2013/0051853 A1* 2/2013 Kato ..... G03G 15/0189 399/119

FOREIGN PATENT DOCUMENTS

JP 2009-288306 A 12/2009
JP 2010-134237 A 6/2010

* cited by examiner

*Primary Examiner* — Thomas Giampaolo, II
(74) *Attorney, Agent, or Firm* — Oliff PLC

(57) ABSTRACT

An image forming apparatus is provided with an image holder that holds an electrostatic latent image, a developing unit that develops the electrostatic latent image of the image holder, a biasing unit that biases the developing unit toward the image holder; and a holding member that holds the biasing unit and is disposed so that a part which is opposite to a biasing direction of the biasing unit is in contact with an image forming apparatus main body directly or via another member.

13 Claims, 34 Drawing Sheets

IMAGE FORMING APPARATUS AND METHOD

CROSS-REFERENCE TO RELATED APPLICATIONS

This application is based on and claims priority under 35 USC 119 from Japanese Patent Application No. 2016-034201 filed Feb. 25, 2016.

BACKGROUND

Technical Field

The present invention relates to an image forming apparatus.

SUMMARY

According to an aspect of the invention, there is provided an image forming apparatus including:

an image holder that holds an electrostatic latent image;

a developing unit that develops the electrostatic latent image of the image holder;

a biasing unit that biases the developing unit toward the image holder; and a holding member that holds the biasing unit and is disposed so that a part which is opposite to a biasing direction of the biasing unit is in contact with an image forming apparatus main body directly or via another member.

BRIEF DESCRIPTION OF THE DRAWINGS

Exemplary embodiments of the present invention will be described in detail based on the following figures, wherein.

DETAILED DESCRIPTION

Hereinafter, the exemplary embodiments of the invention will be described with reference to the drawings.

First Exemplary Embodiment

Figure 1:
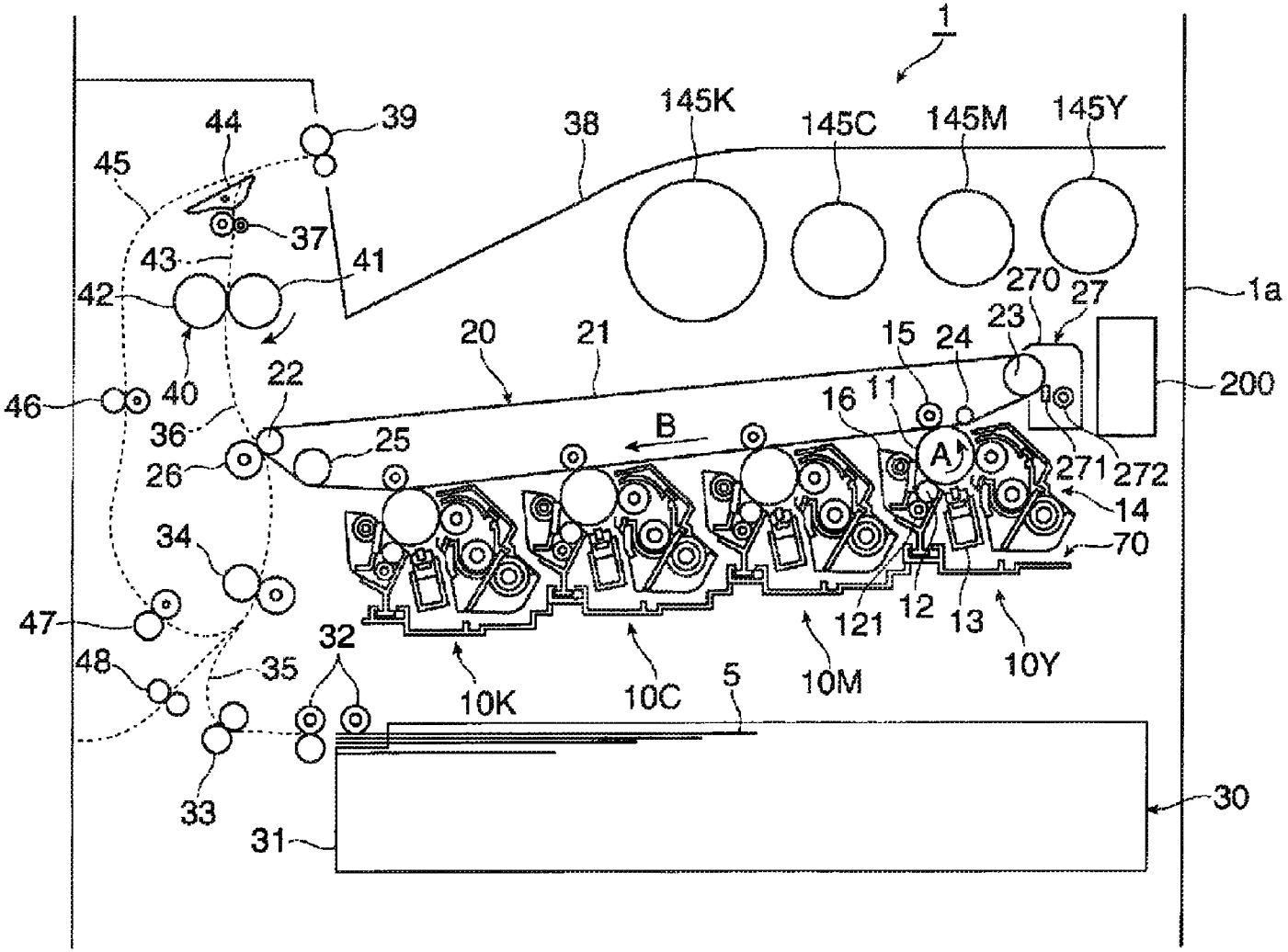
FIG. 1 is a schematic configuration diagram illustrating an image forming apparatus according to a first exemplary embodiment of the invention.
Figure 2:
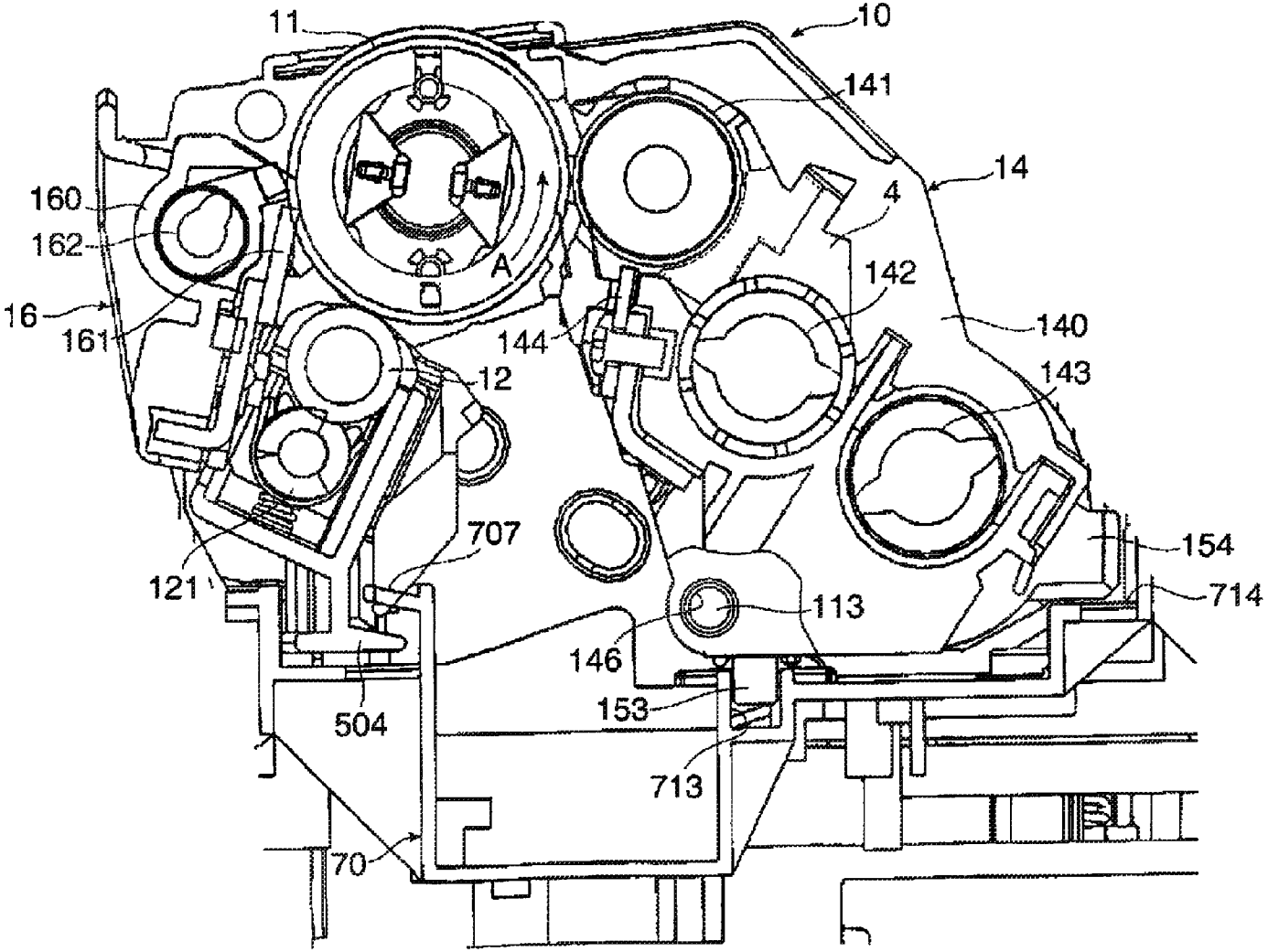
FIG. 2 is a configuration view illustrating an image forming portion of the image forming apparatus according to the first exemplary embodiment of the invention.

FIGS. 1 and 2 are views illustrating an image forming apparatus according to the first exemplary embodiment.

FIG. 1 schematically illustrates the entire image forming apparatus, and FIG. 2 illustrates a view in which main portions (image forming device or the like) are enlarged in the image forming apparatus.

Entire Configuration of Image Forming Apparatus

An image forming apparatus 1 according to the first exemplary embodiment is configured, for example, as a color printer. The image forming apparatus 1 includes: plural image forming devices 10 which forms a toner image developed by toner which configures developer; an intermediate transfer device 20 which holds each toner image formed by each image forming device 10, and finally transports the toner image to a secondary transfer position at which the toner image is secondarily transferred to a recording sheet 5 which is an example of a recording medium; a sheet feeding device 30 which accommodates and transports the necessary recording sheet 5 to be supplied to the secondary transfer position of the intermediate transfer device 20; and a fixing device 40 which fixes the toner image on the recording sheet 5 which is secondarily transferred by the intermediate transfer device 20. In addition, in the drawings, 1*a* illustrates an apparatus main body of the image forming apparatus 1, and the apparatus main body 1*a* includes a support structure member made of a frame, or an external cover. In addition, the dashed line in the drawing illustrates a main transport path through which the recording sheet 5 is transported in the apparatus main body 1*a*.

The image forming device 10 includes four image forming devices 10Y, 10M, 10C, and 10K which exclusively form each toner image of four colors, such as yellow (Y), magenta (M), cyan (C), and black (K). The four image forming devices 10 (Y, M, C, K) are disposed to be in a state of being aligned in one row being inclined in an internal space of the apparatus main body 1*a*. The four image forming devices 10 (Y, M, C, K) are present at a position at which the image forming device 10Y of yellow (Y) color is relatively high and the image forming device 10K of black (K) color is relatively low.

As illustrated in FIG. 1 or 2, each image forming device 10 (Y, M, C, K) of yellow (Y), magenta (M), cyan (C), and black (K) colors is provided with a photoconductor drum 11 which rotates as an example of an image holder, and each device which is an example of the toner image forming unit as described in the following is mainly disposed on the periphery of the photoconductor drum 11. Main devices are a charging device 12 which charges a circumferential surface (image holding surface) on which the photoconductor drum 11 can form an image to a necessary potential; an exposure device 13 which is an example of an electrostatic latent image forming unit that irradiates the charged circumferential surface of the photoconductor drum 11 with light based on information (signal) of the image, and forms an electrostatic latent image (for each color) having a potential difference; a developing device 14 which is an example of a developing unit that develops the electrostatic latent image by the toner of the developer of corresponding color (Y, M, C, K), and makes the electrostatic latent image into the toner image; a primary transfer device 15 which is an example of a primary transfer unit that transfers each toner image to the intermediate transfer device 20; and a drum cleaning device 16 which removes an adhered material, such as toner that remains and adheres to the image holding surface of the photoconductor drum 11 after the primary transfer, and performs cleaning. Furthermore, in FIG. 1, symbols which illustrate the photoconductor drum 11 or the charging device 12 will be attached only to the image forming device 10Y of yellow (Y) color, and will be omitted in other image forming devices 10 (M, C, K).

The photoconductor drum 11 is a member which forms the image holding surface having a photoconductive layer (photosensitive layer) made of a photosensitive material on the circumferential surface of a cylindrical or columnar base material to which grounding processing is performed. The photoconductor drum 11 is supported to rotate in the direction illustrated by an arrow A after power is transmitted from a driving device which is not illustrated.

The charging device 12 includes a contact type charging roll which is disposed in a state of being in contact with the photoconductor drum 11. The charging device 12 has a cleaning roll 121 which cleans the front surface thereof. Charging voltage is supplied to the charging device 12. In a case where the developing device 14 performs reversal development, as the charging voltage, voltage or current having the same polarity as a charging polarity of the toner supplied from the developing device 14 is supplied. In addition, as the charging device 12, a non-contact type charging device, such as a scorotron, which is disposed in a non-contact state on the front surface of the photoconductor drum 11 may be employed.

The exposure device 13 is made of an LED print head which irradiates the photoconductor drum 11 with the light in accordance with image information by light emitting diodes (LED) which are plural light emitting elements arranged along the shaft direction of the photoconductor drum 11, and forms the electrostatic latent image. In addition, as the exposure device 13, a device which performs defective scanning with laser light configured in accordance with the image information along the shaft direction of the photoconductor drum 11, may be used.

As illustrated in FIG. 2, any developing device 14 is configured by disposing a developing roll 141 which holds developer 4 and transports the developer 4 to a development region that faces the photoconductor drum 11, agitation and transport members 142 and 143, such as two screw augers that transport the developer 4 to pass through the developing roll 141 while agitating the developer 4, and a layer thickness regulating member 144 which regulates an amount (layer thickness) of the developer held by the developing roll 141, on the inside of a housing 140 in which an opening portion and an accommodation chamber of the developer 4 are formed. Development voltage is supplied to between the developing roll 141 and the photoconductor drum 11 from a power source device which is not illustrated, in the developing device 14. In addition, the developing roll 141 or the agitation and transport members 142 or 143 rotate in the necessary direction after the power is transmitted from the driving device which is not illustrated. Furthermore, as the above-described developer 4 of four colors, two-component developer including non-magnetic toner and magnetic carrier is used.

The primary transfer device 15 is a contact type transfer device provided with a primary transfer roll which comes into contact with the periphery of the photoconductor drum 11 via an intermediate transfer belt 21 and rotates, and to which primary transfer voltage is supplied. As the primary transfer voltage, DC voltage which indicates a polarity reverse to the charging polarity of the toner is supplied from the power source device which is not illustrated.

As illustrated in FIG. 2, the drum cleaning device 16 includes a container shape main body 160 in which a part thereof is open, a cleaning plate 161 which is disposed to come into contact with the circumferential surface of the photoconductor drum 11 after the primary transfer at necessary pressure, removes the adhered material, such as residual toner, and performs the cleaning, and a sending member 162, such as a screw auger, which collects the adhered material, such as toner removed by the cleaning plate 161, and transports the adhered material to send out the adhered material to a collection system which is not illustrated. As the cleaning plate 161, a plate shaped member (for example, blade) made of a material, such as rubber, is used.

As illustrated in FIG. 1, the intermediate transfer device 20 is disposed to be present at a position above each image forming device 10 (Y, M, C, K). The intermediate transfer device 20 mainly includes the intermediate transfer belt 21 which rotates in the direction illustrated by an arrow B while passing through the primary transfer position between the photoconductor drum 11 and the primary transfer device 15 (primary transfer roll); plural belt support rolls 22 to 25 which hold the intermediate transfer belt 21 in a desired state from the inner surface, and support the intermediate transfer belt 21 to be rotatable; a secondary transfer device 26 which is an example of a secondary transfer unit which is disposed on the outer circumferential surface (image holding surface) side of the intermediate transfer belt 21 supported by the belt support roll 22 and secondarily transfers the toner image on the intermediate transfer belt 21 to the recording sheet 5; and a belt cleaning device 27 which removes the adhered material, such as toner or paper dust, which remains and adheres to the outer circumferential surface of the intermediate transfer belt 21 after passing through the secondary transfer device 26, and performs the cleaning. The intermediate transfer device 20 is configured so that the intermediate transfer belt 21 stretched to a belt support roll 24 and the primary transfer device 15 is movable to a retreat position which is separated from the photoconductor drum 11 (Y, M, C, K), by operating an operation handle which is not illustrated.

As the intermediate transfer belt 21, an endless belt which is made of a material obtained by dispersing a resistance adjusting agent or the like, such as carbon black into a synthetic resin, such as a polyimide resin or a polyamide resin, is used. In addition, the belt support roll 22 is configured as a back surface support roll of the secondary transfer, the belt support roll 23 is configured as a driving roll which is driven to rotate by the driving device which is not illustrated, the belt support roll 24 is configured as a surface shaping roll which forms an image forming surface of the intermediate transfer belt 21, and the belt support roll 25 is configured as a tension applying roll which applies tension to the intermediate transfer belt 21.

As illustrated in FIG. 1, the secondary transfer device 26 is a contact type transfer device provided with a secondary transfer roll which comes into contact with the circumferential surface of the intermediate transfer belt 21 and rotates, and to which secondarily transfer voltage is supplied, at the secondary transfer position which is a part on the outer circumferential surface of the intermediate transfer belt 21 supported by the belt support roll 22 in the intermediate transfer device 20. In addition, the DC voltage which indicates the polarity opposite to or the same as the charging polarity of the toner is supplied from the power source device which is not illustrated as the secondary transfer voltage, to the secondary transfer device 26 or the belt support roll 22 of the intermediate transfer device 20.

As illustrated in FIG. 1, the belt cleaning device 27 includes a container shape main body 270 in which a part thereof is open, a cleaning plate 271 which is disposed to come into contact with the circumferential surface of the intermediate transfer belt 21 after the secondary transfer at necessary pressure, removes the adhered material, such as residual toner, and performs the cleaning, and a sending member 272, such as a screw auger, which collects the adhered material, such as toner removed by the cleaning plate 271, and transports the adhered material to send out the adhered material to the collection system which is not illustrated. As the cleaning plate 271, a plate shaped member (for example, blade) made of a material, such as rubber, is used.

The fixing device 40 is configured by disposing a roll shape or belt shape heating rotating body 41 which rotates in the direction illustrated by an arrow, and is heated by a heating unit so that the front surface temperature is held to be a predetermined temperature, on the inside of the housing which is not illustrated and in which an enter port and an outlet port of the recording sheet 5 are formed; and a roll shape or belt shape pressure rotating body 42 which is in contact with the heating rotating body 41 at necessary pressure and is driven to rotate in a state of being substantially along the shaft direction of the heating rotating body 41. In the fixing device 40, the contact portion in which the heating rotating body 41 and the pressure rotating body 42 comes into contact with each other becomes a fixing processing portion which performs necessary fixing processing (heating and pressurizing). In addition, as the heating rotating body 41, for example, a heating belt which generates heat by an electromagnetic induction action is used, and as the pressure rotating body 42, for example, a soft roll in which a modulus of elasticity is relatively low on the outer circumference of a cylindrical core bar and with which is an elastic body layer is coated.

The sheet feeding device 30 is disposed to be present at a position on a lower side of the image forming device 10 (Y, M, C, K). The sheet feeding device 30 mainly includes a single (or plural) sheet accommodating member 31 which accommodates the recording sheet 5 having a desired size or type in a layered state, and a sending device 32 which sends the recording sheets 5 one by one out of the sheet accommodating member 31. The sheet accommodating member 31 is attached, for example, to be drawn out to a front surface (side surface which a user opposes during the operation) of the apparatus main body 1*a*.

Examples of the recording sheet 5 include plain paper which is used in a copy machine of electrophotographic system or a printer, thin paper, such as tracing paper, or an OHP sheet. In order to further improve flatness of an image front surface after the fixing, the front surface of the recording sheet 5 is also preferable as flat as possible, and for example, it is possible to appropriately use a so-called thick sheet having a relatively large basis weight, such as coated paper made by coating the front surface of the plain paper with a resin or the like, or art paper for printing.

A sheet feeding and transporting path 35 which includes a single or plural sheet transport roll pairs 33 and 34 that transports the recording sheet 5 sent out of the sheet feeding device 30 to a secondary transfer position, and a transporting guide which is not illustrated, is provided between the sheet feeding device 30 and the secondary transfer device 26. The sheet transport roll pair 34 disposed at a position which is immediately in front of the secondary transfer position in the sheet feeding and transporting path 35 serves, for example, as a roll (registration roll) which adjusts a transporting period of the recording sheet 5. In addition, a sheet transport path 36 for transporting the recording sheet 5 which is sent out of the secondary transfer device 26 after the secondary transfer to the fixing device 40, is provided between the secondary transfer device 26 and the fixing device 40. Furthermore, at a part close to the outlet port of the sheet formed in the image forming apparatus main body 1*a*, an output transport path 43 provided with a sheet output roll pair 39 for outputting the recording sheet 5 which is sent out of the fixing device 40 by an output port roll 37 after the fixing, to a sheet output portion 38 of the upper portion of the image forming apparatus main body 1*a*, is provided.

A switching gate 44 which switches the sheet transport path is provided between the fixing device 40 and the sheet output roll pair 39. The sheet output roll pair 39 is capable of switching the rotational direction to the normal rotational direction (output direction) and the reverse rotational direction. In a case of forming the image on both surfaces of the recording sheet 5, after a rear end of the recording sheet 5 on which the image is formed on one surface passes through the switching gate 44, the rotational direction of the sheet output roll pair 39 is switched from the normal rotational direction (output direction) to the reverse rotational direction. The transport path of recording sheet 5 transported in the reverse rotational direction by the sheet output roll pair 39 is switched by the switching gate 44, and the recording sheet 5 is transported to a transport path for both surfaces 45 formed to be along substantially the vertical direction along the side surface of the image forming apparatus main body 1*a*. The transport path for both surfaces 45 is provided with sheet transport roll pairs 46 and 47 which transport the recording sheet 5 to the sheet transport roll pair 34 in a state where a front surface and a back surface are reversed to each other, and a transporting guide or the like which is not illustrated. In addition, a reference numeral 48 indicates the sheet transport roll pair which transports the recording sheet 5 supplied from a manual feed tray which is not illustrated to the sheet transport roll pair 34.

In FIG. 1, reference numerals 145 (Y, M, C, K) respectively indicates plural toner cartridges which are arranged along the direction orthogonal to a sheet surface, and which accommodates the developer including at least the toner supplied to the corresponding developing device 14.

In addition, a reference numeral 200 in FIG. 1 indicates a control device which integrally controls the operation of the image forming apparatus 1. The control device 200 is provided with a central processing unit (CPU) or a read only memory (ROM) which is not illustrated, a random access memory (RAM), or a bus which connects the CPU or the ROM, or a communication interface.

Furthermore, as will be described later, a reference numeral 70 in FIG. 1 indicates a part of an insertion guide member which guides a process cartridge 100 when attaching and detaching the process cartridge 100 that configures each image forming device 10 (Y, M, C, K) of yellow (Y), magenta (M), cyan (C), and black (K) colors to and from the image forming apparatus main body 1*a*.

Operation of Image Forming Apparatus

Hereinafter, basic image forming operations by the image forming apparatus 1 will be described.

Here, operations in a full-color mode which forms full-color images configured by combining the toner images of four colors (Y, M, C, K) by using the four image forming devices 10 (Y, M, C, K), will be described.

When the image forming apparatus 1 receives required command information of an image forming operation (print) of full-color from a user interface or a print driver which is not illustrated, the operations of the four image forming devices 10 (Y, M, C, K), the intermediate transfer device 20, the secondary transfer device 26, and the fixing device 40 are started.

In addition, in each image forming device 10 (Y, M, C, K), as illustrated in FIGS. 1 and 2, first, each photoconductor drum 11 rotates in the direction illustrated by the arrow A, and each charging device 12 respectively charges the front surface of each photoconductor drum 11 to the necessary polarity (negative polarity in the first exemplary embodiment) and potential. Next, the exposure device 13 irradiates the front surface of the photoconductor drum 11 after the charging with the light exposed based on a signal of the image obtained by converting the information of the image input to the image forming apparatus 1 to each color component (Y, M, C, K), and forms each electrostatic latent image of each color component configured at a necessary potential difference on the front surface.

Next, each image forming device 10 (Y, M, C, K) performs the development with respect to the electrostatic latent image of each color component formed in the photoconductor drum 11 by respectively supplying the toner of the corresponding color (Y, M, C, K) charged to the necessary polarity (negative polarity) from the developing roll 141, and by making the toner electrostatically adhere. By the development, the electrostatic latent image of each color component formed in each photoconductor drum 11, is developed as the toner images of four colors (Y, M, C, K) which are respectively developed by the toner of the corresponding color.

Next, when the toner images of each color formed on the photoconductor drum 11 of each image forming device 10 (Y, M, C, K) is transported to the primary transfer position, the primary transfer device 15 is primarily transferred in a state where the toner images of each color overlap in order on the intermediate transfer belt 21 which rotates in the direction illustrated by the arrow B of the intermediate transfer device 20.

In addition, in each image forming device 10 (Y, M, C, K) in which the primary transfer is finished, the drum cleaning device 16 removes the adhered material by scraping the adhered material, and cleans the front surface of the photoconductor drum 11. Accordingly, each image forming device 10 (Y, M, C, K) is placed in a state where the next image forming operation is possible.

Next, in the intermediate transfer device 20, the toner image which is primarily transferred by the rotation of the intermediate transfer belt 21 is held, and is transported to the secondary transfer position. Meanwhile, in the sheet feeding device 30, the necessary recording sheet 5 is sent out to the sheet feeding and transporting path 35 in accordance with the image forming operation. In the sheet feeding and transporting path 35, the sheet transport roll pair 34 which is the registration roll supplies the recording sheet 5 by sending out the recording sheet 5 to the secondary transfer position in accordance with the transfer period.

At the secondary transfer position, the secondary transfer device 26 integrally secondarily transfers the toner image on the intermediate transfer belt 21 to the recording sheet 5. In addition, in the intermediate transfer device 20 in which the secondary transfer is finished, the belt cleaning device 27 removes the adhered material, such as toner, remaining on the front surface of the intermediate transfer belt 21 after the secondary transfer, and performs the cleaning.

Next, the recording sheet 5 to which the toner image is secondarily transferred is transported to the fixing device 40 from the sheet transport path 36 after being peeled from the intermediate transfer belt 21. In the fixing device 40, by making the recording sheet 5 after the secondary transfer enter and pass through the contact portion between the rotating heating rotating body 41 and the pressure rotating body 42, the unfixed toner image is fixed to the recording sheet 5 by performing required fixing processing (heating and pressurizing). Finally, the recording sheet 5 after the fixing is finished is output, for example, to the sheet output portion 38 installed in the upper portion of the apparatus main body 1*a*, by the sheet output roll pair 39 during the image forming operation only by forming the image to one surface thereof.

By the above-described operations, the recording sheet 5 on which the full-color image configured by combining the toner images of four colors is formed, is output.

Configuration of Process Cartridge

Figure 3:
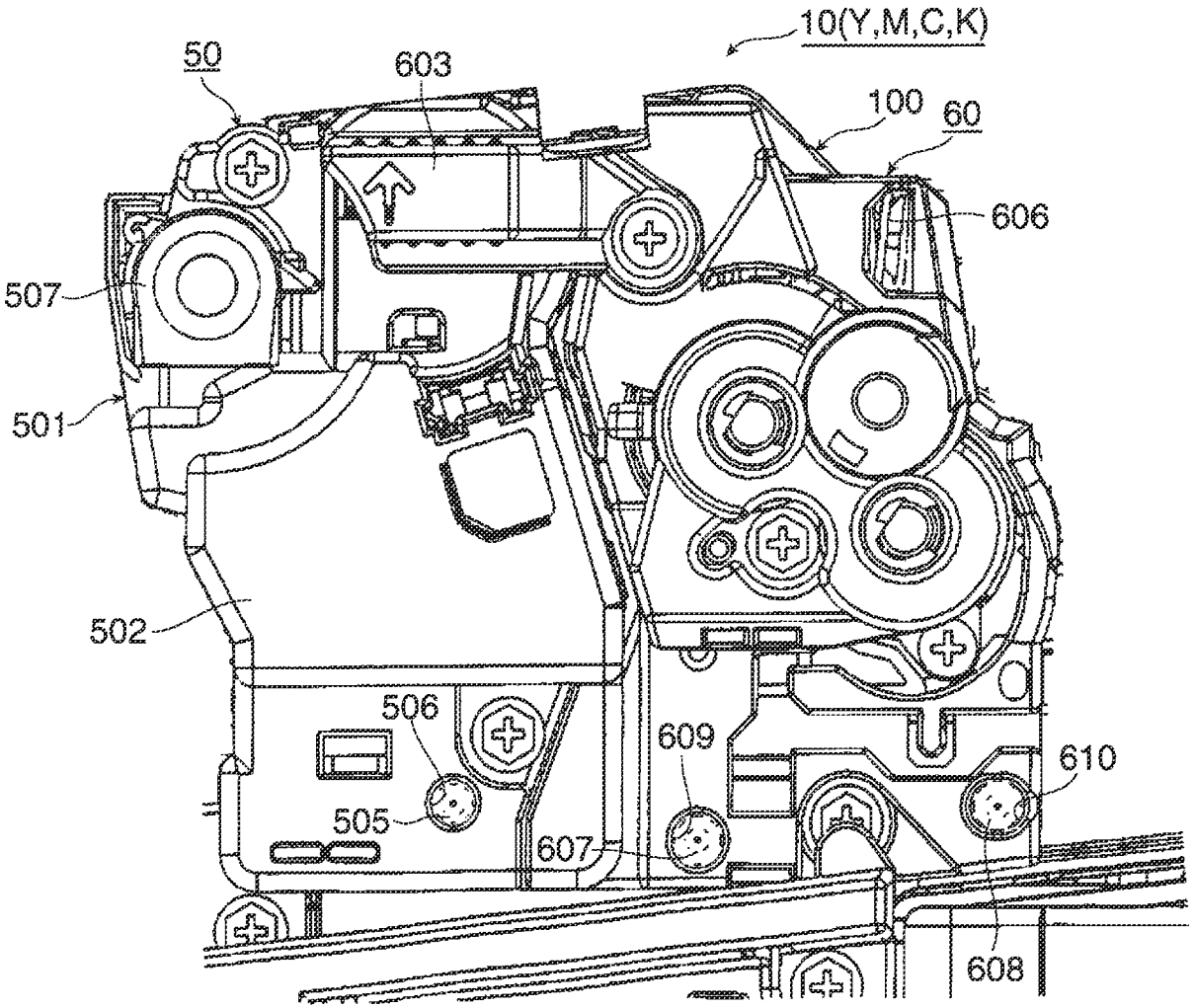
FIG. 3 is a front configuration view illustrating an image forming device of the image forming apparatus according to the first exemplary embodiment of the invention.

However, in the present exemplary embodiment, as illustrated in FIG. 3, main members which configure each image forming device 10 (Y, M, C, K) of yellow (Y), magenta (M), cyan (C), and black (K) colors, are detachably attached to the image forming apparatus main body 1*a* as the process cartridge 100. The process cartridge 100 considers a difference or the like of an exchange time of the members which configure the image forming device 10, and is provided with a photoconductor unit 50, a developing unit 60, and an exposure unit that is not illustrated, which are an example of plural attachable and detachable structures (image forming units). The photoconductor unit 50, the developing unit 60, and the exposure unit are detachably attached to the image forming apparatus main body 1*a* independently.

Photoconductor Unit

Figure 4:
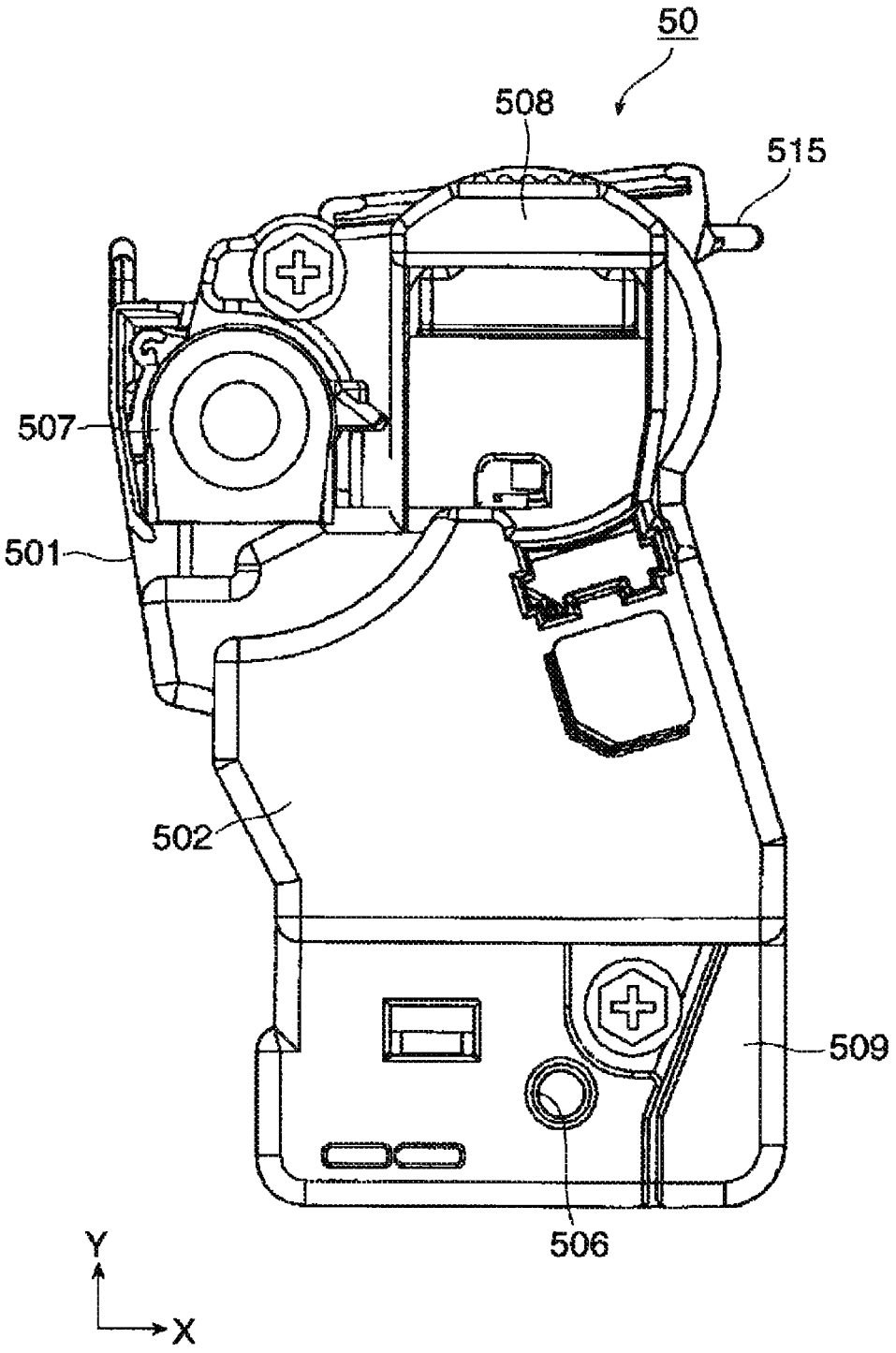
FIG. 4 is a front configuration view illustrating a photoconductor unit.
Figure 5:
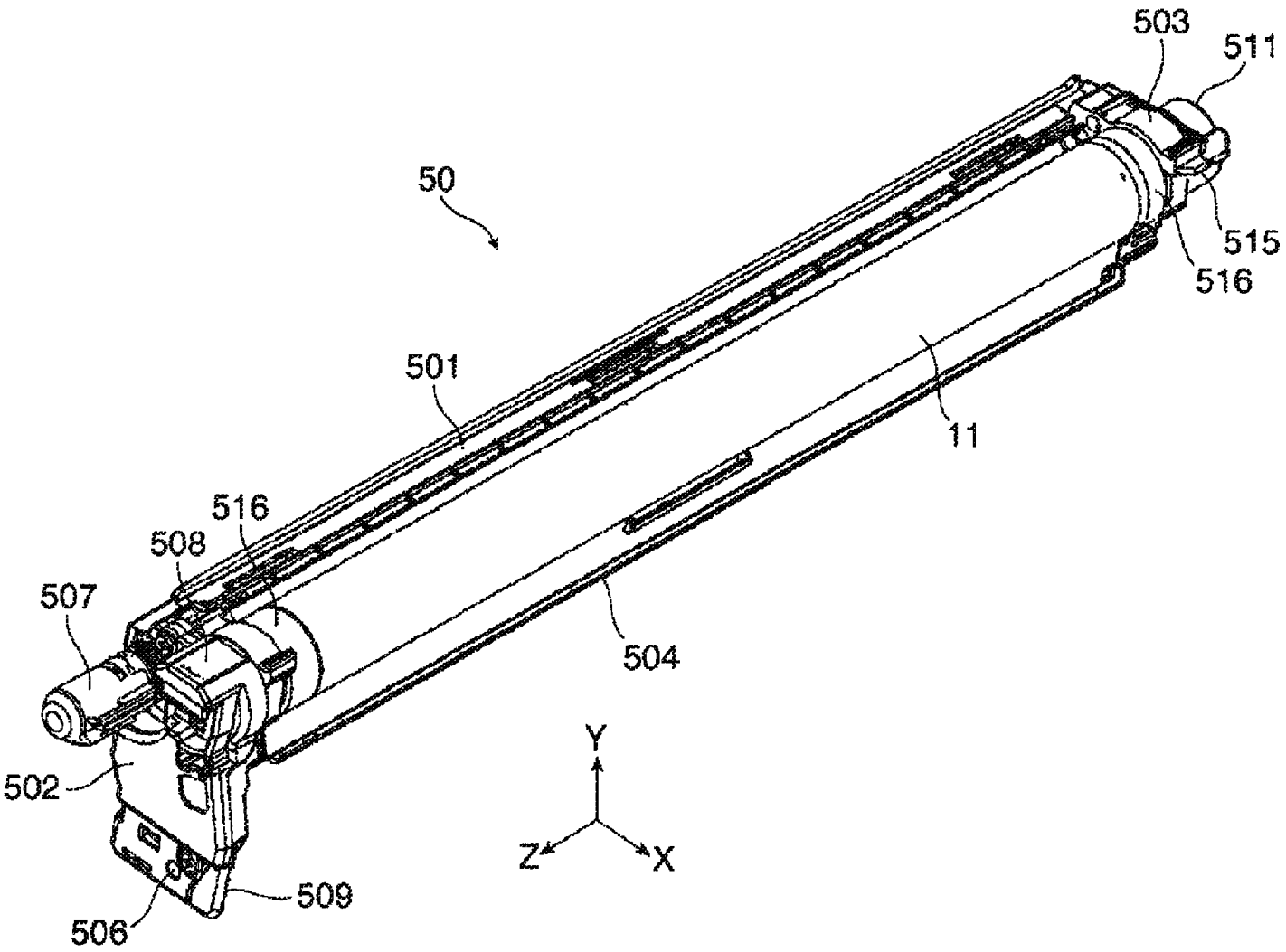
FIG. 5 is a perspective configuration view illustrating the photoconductor unit.
Figure 6:
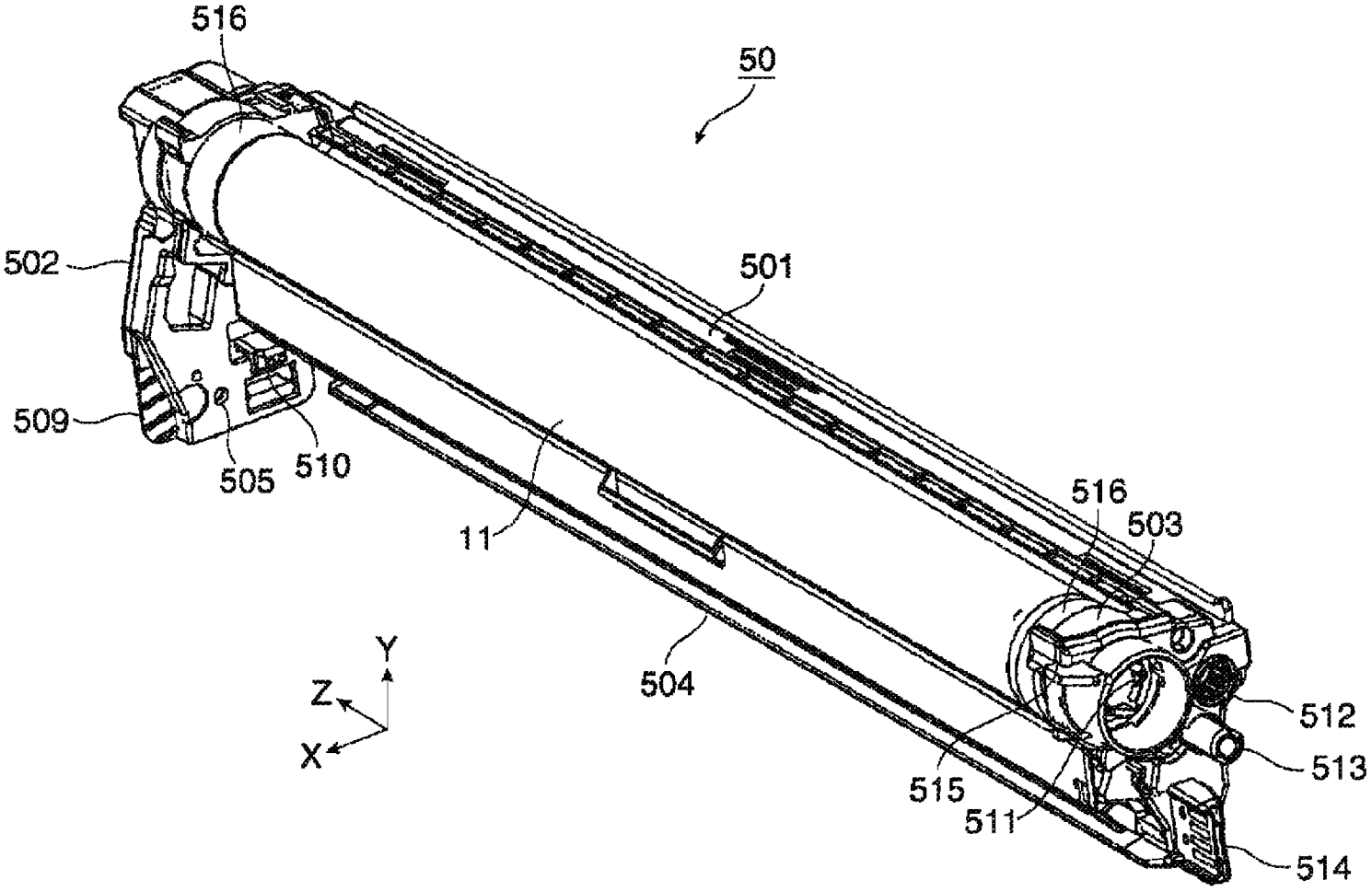
FIG. 6 is a perspective configuration view illustrating the photoconductor unit.

FIG. 4 is a front view illustrating the photoconductor unit, FIG. 5 is an appearance perspective view when the photoconductor unit is viewed diagonally from above on the near side along the mounting direction, and FIG. 6 is an appearance perspective view when the photoconductor unit is viewed diagonally from above on the tip end side (far side) along the mounting direction.

As illustrated in FIGS. 2, 4, and 6, the photoconductor unit 50 is provided with the photoconductor drum 11, the charging device 12 which is disposed diagonally below the photoconductor drum 11, and a photoconductor unit main body 501 which is mounted being a unit integrally with the drum cleaning device 16 disposed on the side of the photoconductor drum 11. The photoconductor unit main body 501 includes front and rear frame portions 502 and 503 which are respectively disposed in end portions on the near side and on the far side along the mounting direction of the photoconductor unit 50, and support the photoconductor drum 11 to be rotatable. In the lower end portion of the photoconductor unit main body 501, a guide portion 504 (refer to FIG. 2) having a substantially downward T shape which guides the photoconductor unit 50 when mounting the photoconductor unit 50 on the image forming apparatus main body 1*a*, is provided across substantially the entire length along the longitudinal direction.

In the front frame portion 502 of the photoconductor unit 50, as illustrated in FIG. 3, a positioning hole 506 into which a columnar positioning projection 505 provided in the end portion on the front surface side of the image forming apparatus main body 1*a* is inserted when mounting the photoconductor unit 50 on the image forming apparatus main body 1*a*, is open. In addition, in the front frame portion 502, a substantially cylindrical output portion 507 which outputs a collected material that is collected by the drum cleaning device 16 and sent out by the sending member 162, is provided in a state of protruding to the front surface side. The collected material output from the output portion 507 of the front frame portion 502 is collected by a collection system which is not illustrated and is disposed on the front surface side of the image forming apparatus main body 1*a*.

First, in an upper end portion of the front frame portion 502, as illustrated in FIGS. 4 and 5, a handle portion 508 which is grasped by a hand when attaching and detaching the photoconductor unit 50 to and from the image forming apparatus main body 1*a*, is provided. In addition, in the lower end portion of the front frame portion 502, a substantially triangular regulating plate section 509 which protrudes toward the developing unit 60 side, is disposed. As will be described later, the regulating plate section 509 prevents the photoconductor unit 50 from being mistakenly mounted on the image forming apparatus main body 1*a* by the developing unit 60 in advance by interrupting with a regulating plate section 611 provided in the developing unit 60. Furthermore, on the back surface of the front frame portion 502, as illustrated in FIG. 6, an identification portion 510 for identifying the photoconductor unit 50 which corresponds to each color, is provided. The disposition or the shape of the identification portion 510 vary for each photoconductor unit 50, and prevents the photoconductor unit 50 which corresponds to each color from being mounted at a different position of the image forming apparatus main body 1*a*.

In addition, in the rear frame portion 503 of the photoconductor unit 50, as illustrated in FIG. 6, a first driving force transmitting portion 511 which transmits the driving force to the photoconductor drum 11, a second driving force transmitting portion 512 which transmits the driving force to the sending member 162 of the drum cleaning device 16, a cylindrical positioning portion 513 which positions the photoconductor unit 50 by inserting the photoconductor unit 50 into a first stud 112 (refer to FIG. 15) that is a positioning member provided in the image forming apparatus main body 1*a*, and a conducting portion 514 for conducting to the charging device 12 or the like, are disposed. Furthermore, in the upper end portion of the rear frame portion 503, a flat-plate shaped projection portion 515 (refer to FIG. 4) which protrudes toward the developing unit 60 side is installed. The projection portion 515 forms a necessary void between the photoconductor unit 50 and the developing unit 60, and prevents the front surface of the photoconductor drum 11 from coming into contact with the developing unit 60 and causing damage, by abutting against a guide rail portion 150 which will be described later of the developing unit 60 mounted on the image forming apparatus main body 1*a* in advance, when mounting the photoconductor unit 50 on the image forming apparatus main body 1*a*.

In both end portions along the shaft direction of the photoconductor drum 11 of the photoconductor unit 50, as will be described later, being in contact with the abutting member 152 on the developing unit 60 side, abutting members 516 made of a bearing member or the like that holds a void (drum to roll space (DRS)) between the photoconductor drum 11 and the developing roll 141 to be a necessary value, are respectively provided.

Developing Unit

Figure 7:
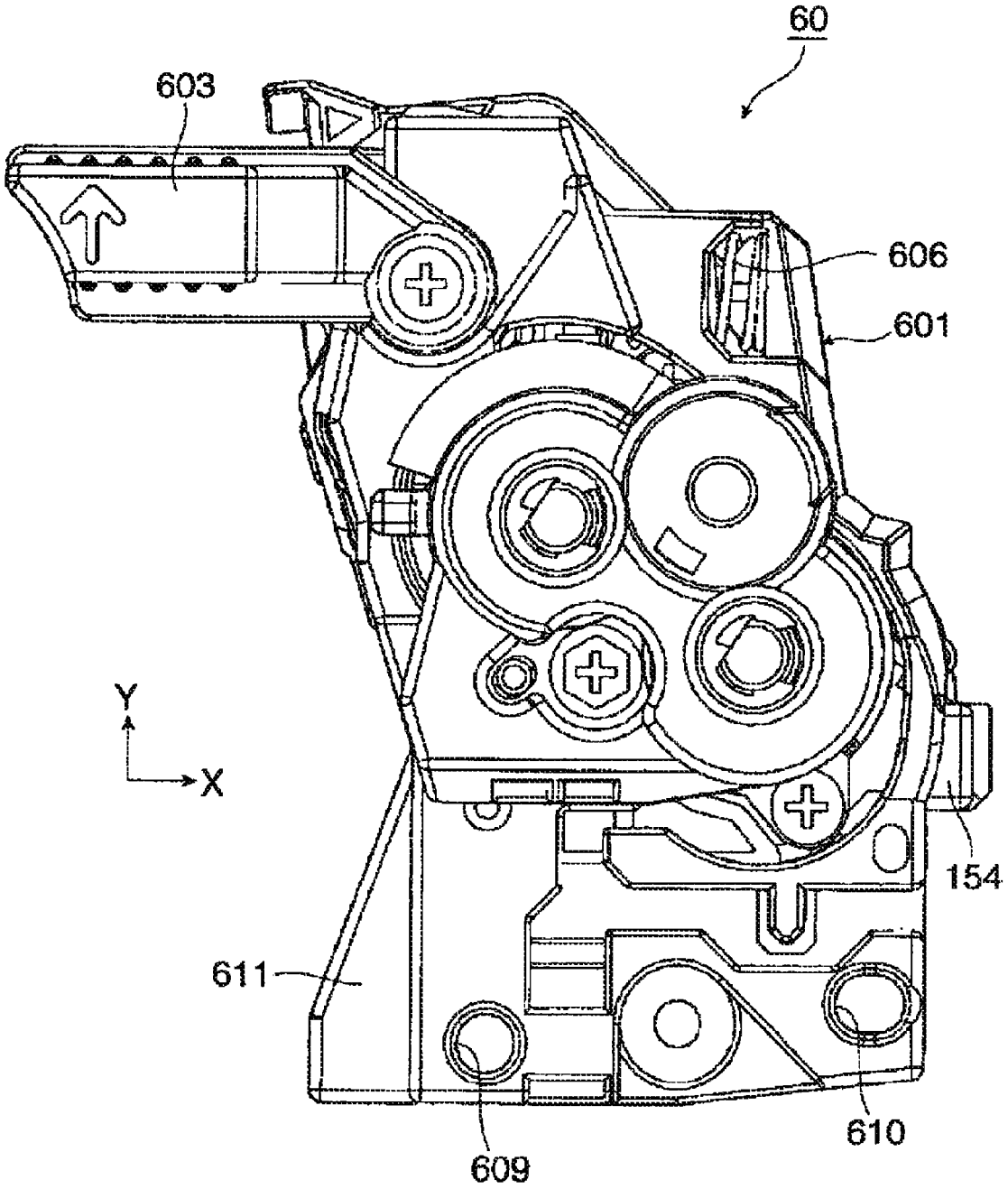
FIG. 7 is a front configuration view illustrating a developing unit.
Figure 8:
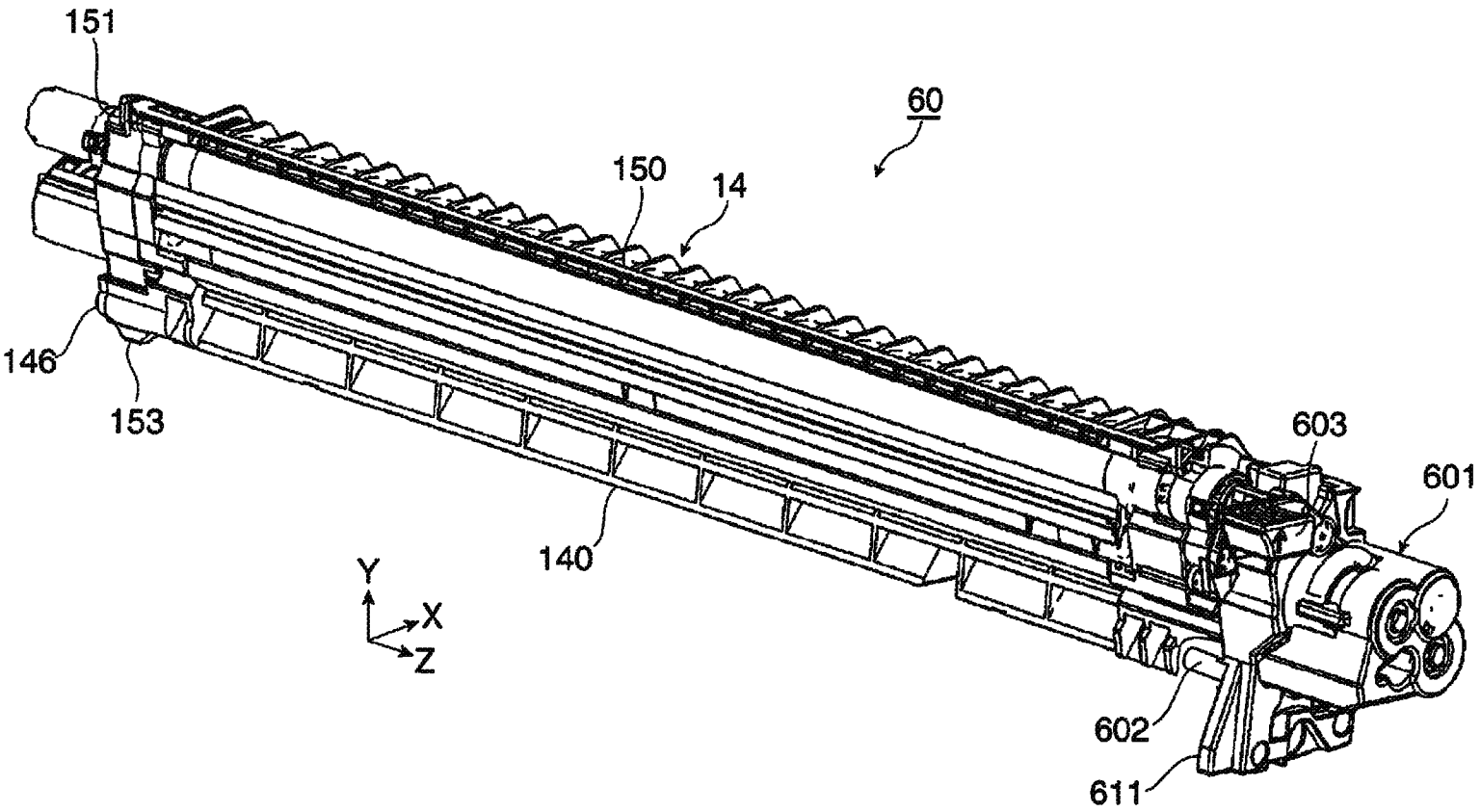
FIG. 8 is a perspective configuration view illustrating the developing unit.
Figure 9:
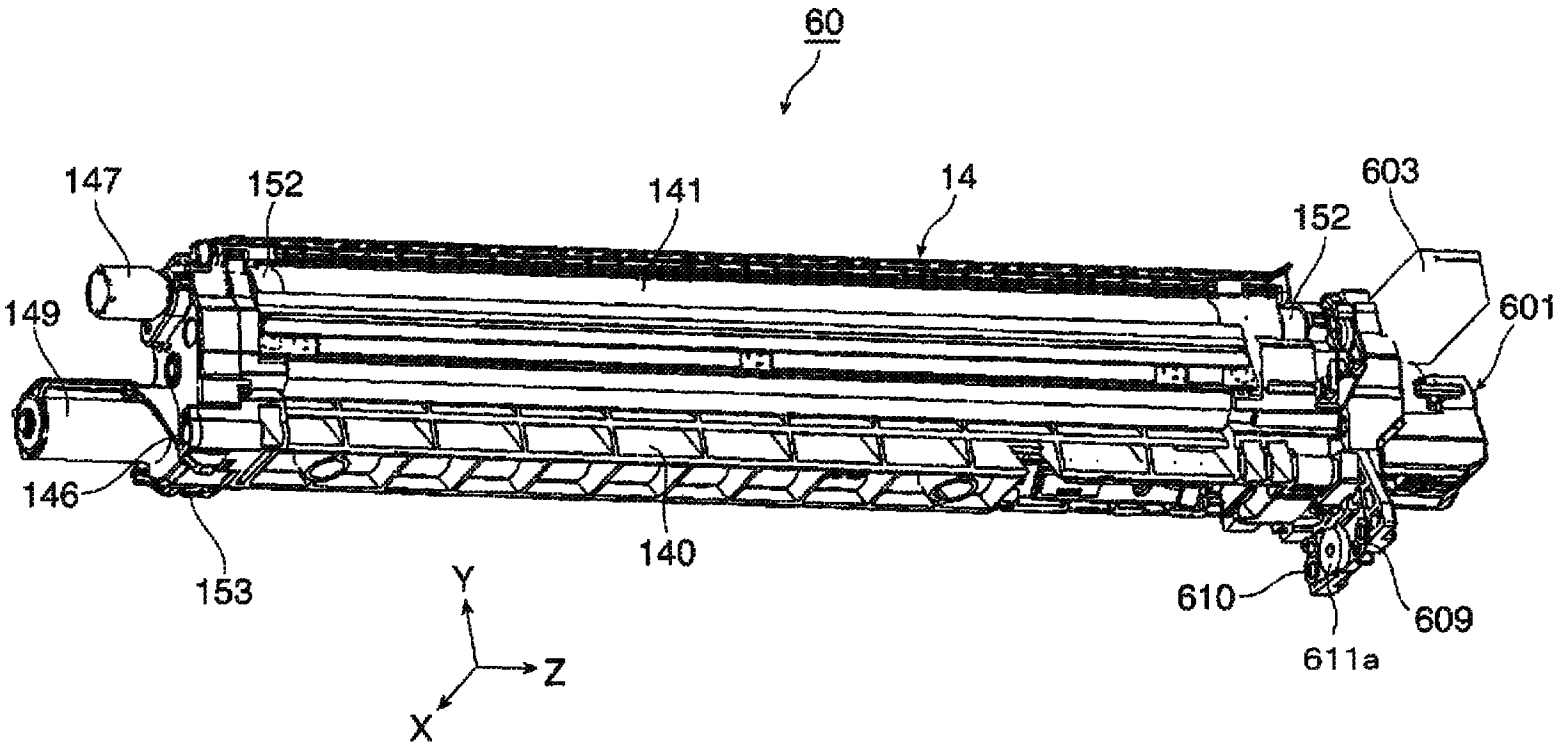
FIG. 9 is a perspective configuration view illustrating the developing unit.
Figure 10:
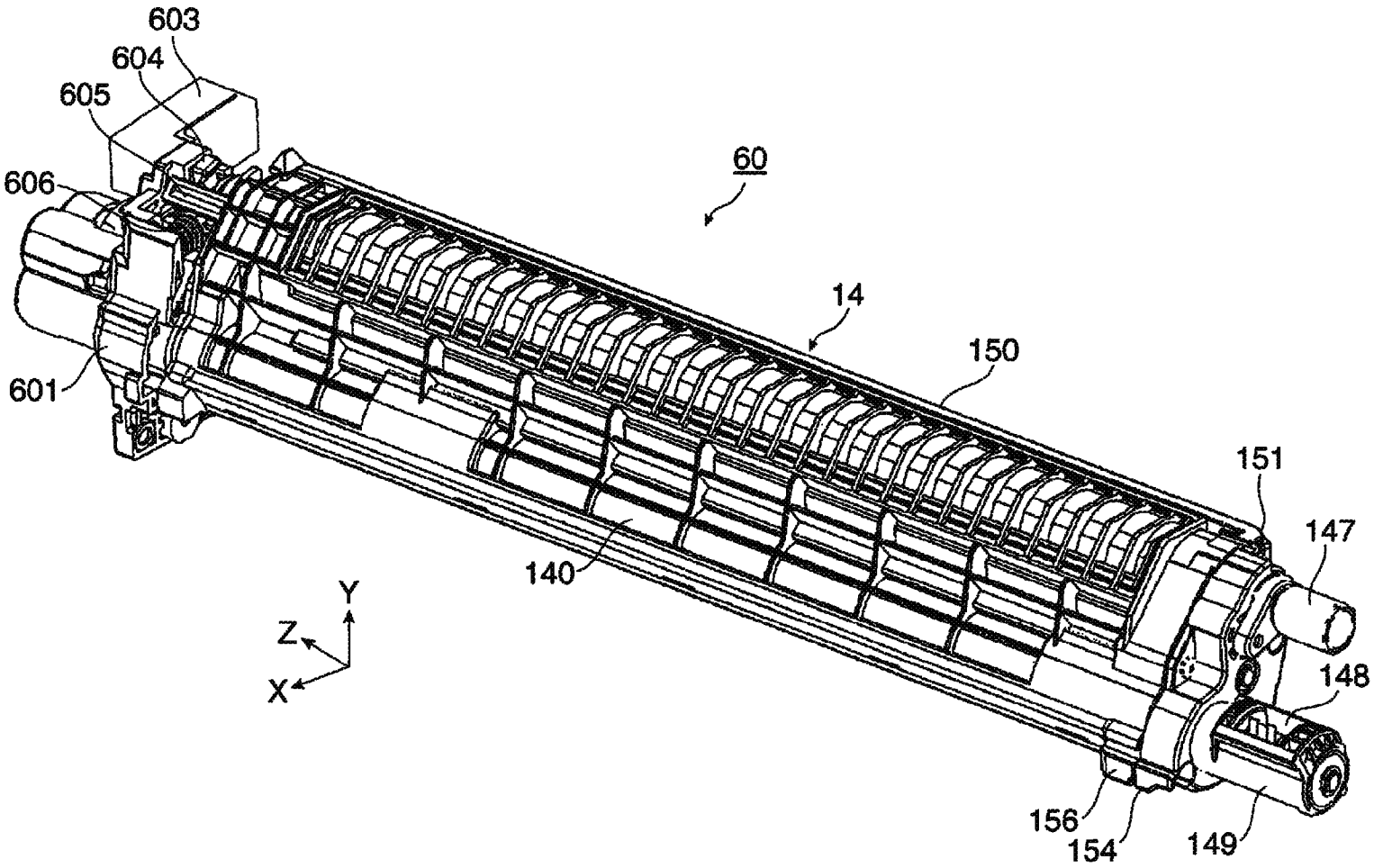
FIG. 10 is a perspective configuration view illustrating the developing unit.

FIG. 7 is a front view illustrating the developing unit, FIG. 8 is an appearance perspective view when the developing unit is viewed diagonally from above on the near side along the mounting direction, FIG. 9 is an appearance perspective view when the developing unit is viewed diagonally from below on the tip end side (far side) along the mounting direction, and FIG. 10 is an appearance perspective view when the developing unit is viewed diagonally from above on the tip end side (far side) along the mounting direction.

As illustrated in FIGS. 7 to 10, the developing unit 60 is provided with the developing device 14, and a holder member 601 which is mounted in the end portion on the near side along the longitudinal direction (mounting direction) of the developing device 14, and holds the developing device 14 to be rotatable. As illustrated in FIGS. 2 and 9, the developing unit 60 has a positioning hole 146 (refer to FIG. 11) as a second stud 113 (refer to FIG. 15) is inserted which is a positioning member provided in the image forming apparatus main body 1*a*, in the lower end portion on the photoconductor unit 50 side on the back surface of the developing device housing 140, when mounting the developing unit 60 on the image forming apparatus main body 1*a*. As illustrated in FIG. 8, the holder member 601 has a rotating shaft 602 which holds the developing device housing 140 to be rotatable, in the end portion on the front surface side of the developing device housing 140 that corresponds to the positioning hole 146. Furthermore, in FIG. 8, the rotating shaft 602 is illustrated by cutting out a part of the developing device housing 140 for convenience.

A switching lever 603 which switches an operation position at which the developing device 14 is near the photoconductor drum 11, and the retreat position at which the developing device 14 is separated from the photoconductor drum 11, is mounted on the holder member 601 to be rotatable. On an inner side surface of the holder member 601, as illustrated in FIG. 10, a cam member 604 which rotates together with the switching lever 603 is provided. In addition, in the end portion on the near side along the longitudinal direction of the developing device 14, an abutting portion 605 which rotates the developing device 14 around the rotating shaft 602 by being pressed by the cam member 604, is provided. Furthermore, on the inner side surface of the holder member 601, a coil spring 606 which configures a part of a biasing unit that biases the developing device 14 to the operation position by pushing the abutting portion 605 from the back surface side.

In the lower end portion of the holder member 601, as illustrated in FIG. 3, positioning holes 609 and 610 which are inserted into positioning projections 607 and 608 provided in the end portion on the front surface side of the image forming apparatus main body 1*a*, when mounting the developing unit 60 on the image forming apparatus main body 1*a*, are open. Furthermore, on the back surface of the holder member 601, as illustrated in FIG. 9, an identification portion 611*a* which identifies the developing unit 60 of each color is provided. The disposition or the shape of the identification portion 611*a* vary for each developing unit 60, and the identification portion 611*a* prevents the developing unit 60 from being mounted at a different position of the image forming apparatus main body 1*a*.

In the end portion on the far side along the longitudinal direction of the developing unit 60, as illustrated in FIG. 10, a third driving force transmission portion 147 which transmits the driving force to the developing roll 141, and a cylindrical supply portion 149 which has a supply port 148 that supplies the developer including at least the toner from the toner cartridge 145 to the developing device 14 by a toner supply device which is not illustrated, are provided. In addition, on the bottom surface of the end portion on the far side along the longitudinal direction of the developing unit 60, as illustrated in FIGS. 2 and 9, a first convex portion 153 which guides the developing unit 60 when mounting the developing unit 60 on the image forming apparatus main body 1*a* is provided to protrude downward on the bottom surface on the photoconductor unit 50 side. Furthermore, in the end portion on the far side along the longitudinal direction of the developing unit 60, as illustrated in FIG. 10, a second convex portion 154 which guides the developing unit 60 when mounting the developing unit 60 on the image forming apparatus main body 1*a* is provided to protrude to the side surface opposite to the photoconductor unit 50.

Figure 11:
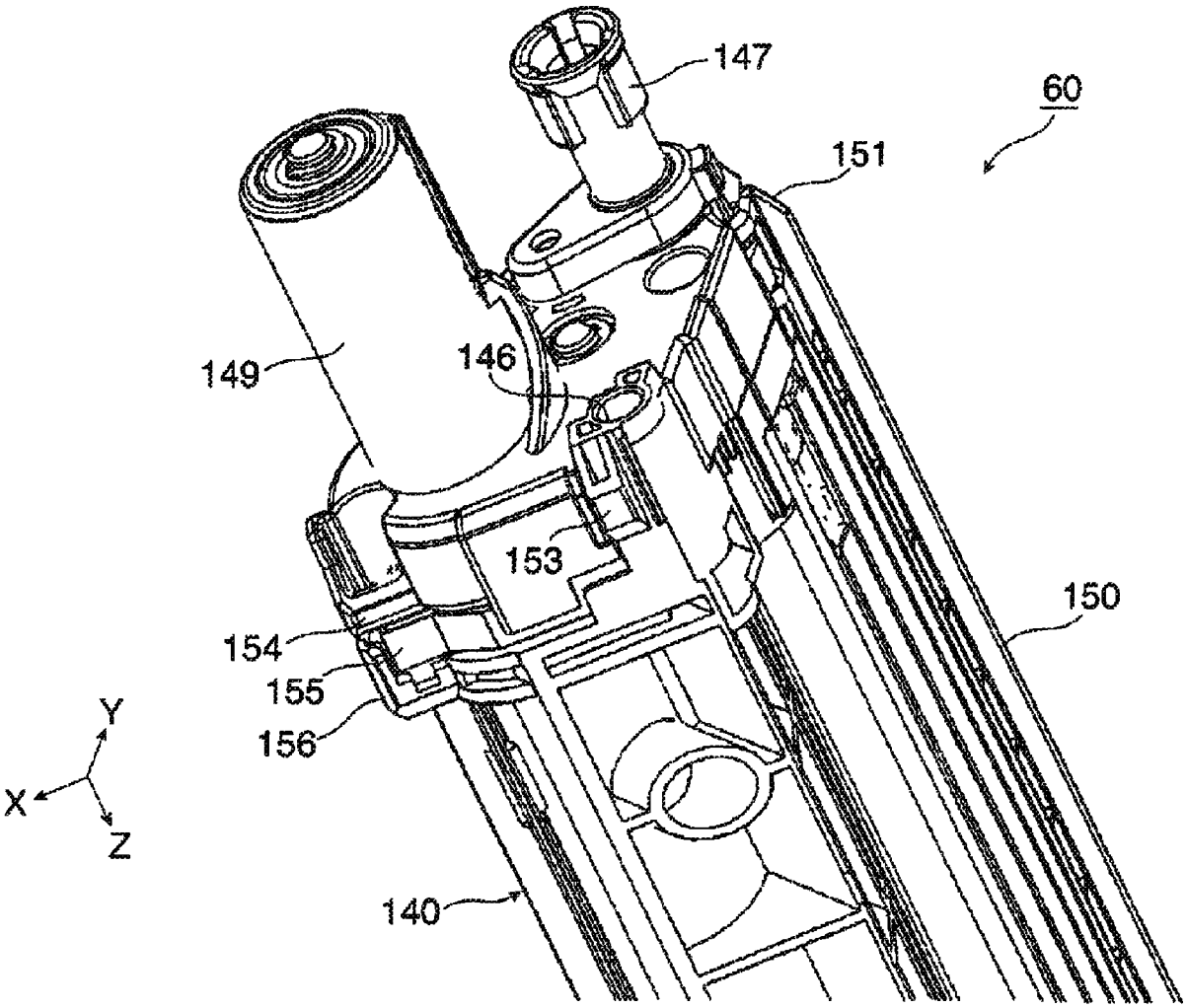
FIG. 11 is a perspective configuration view illustrating main portions of the developing unit.
Figure 12A:
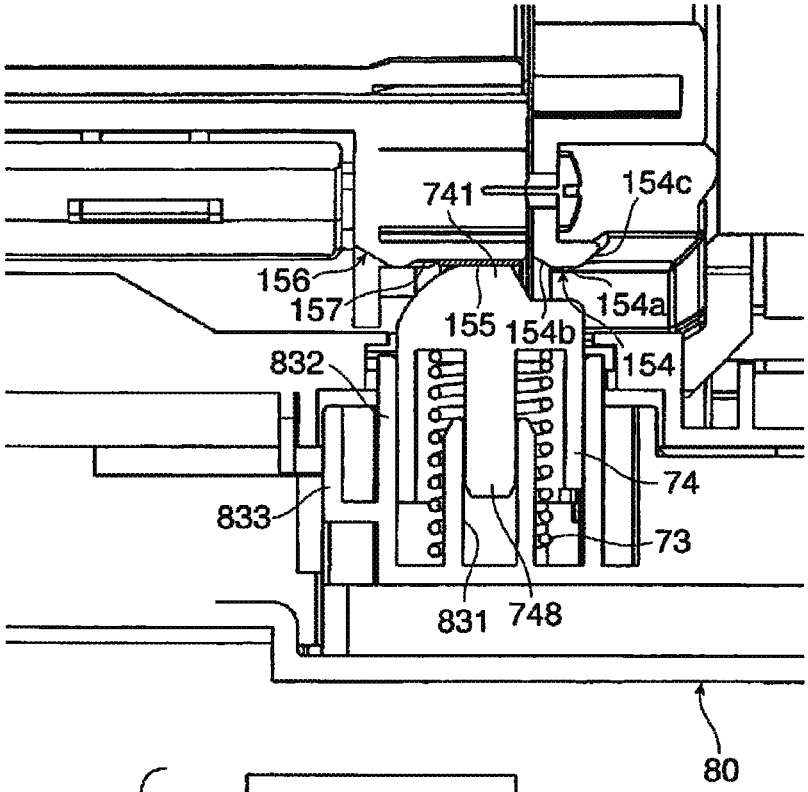
FIG. 12A is a sectional configuration view illustrating main portions of the image forming apparatus according to the first exemplary embodiment of the invention.
Figure 13:
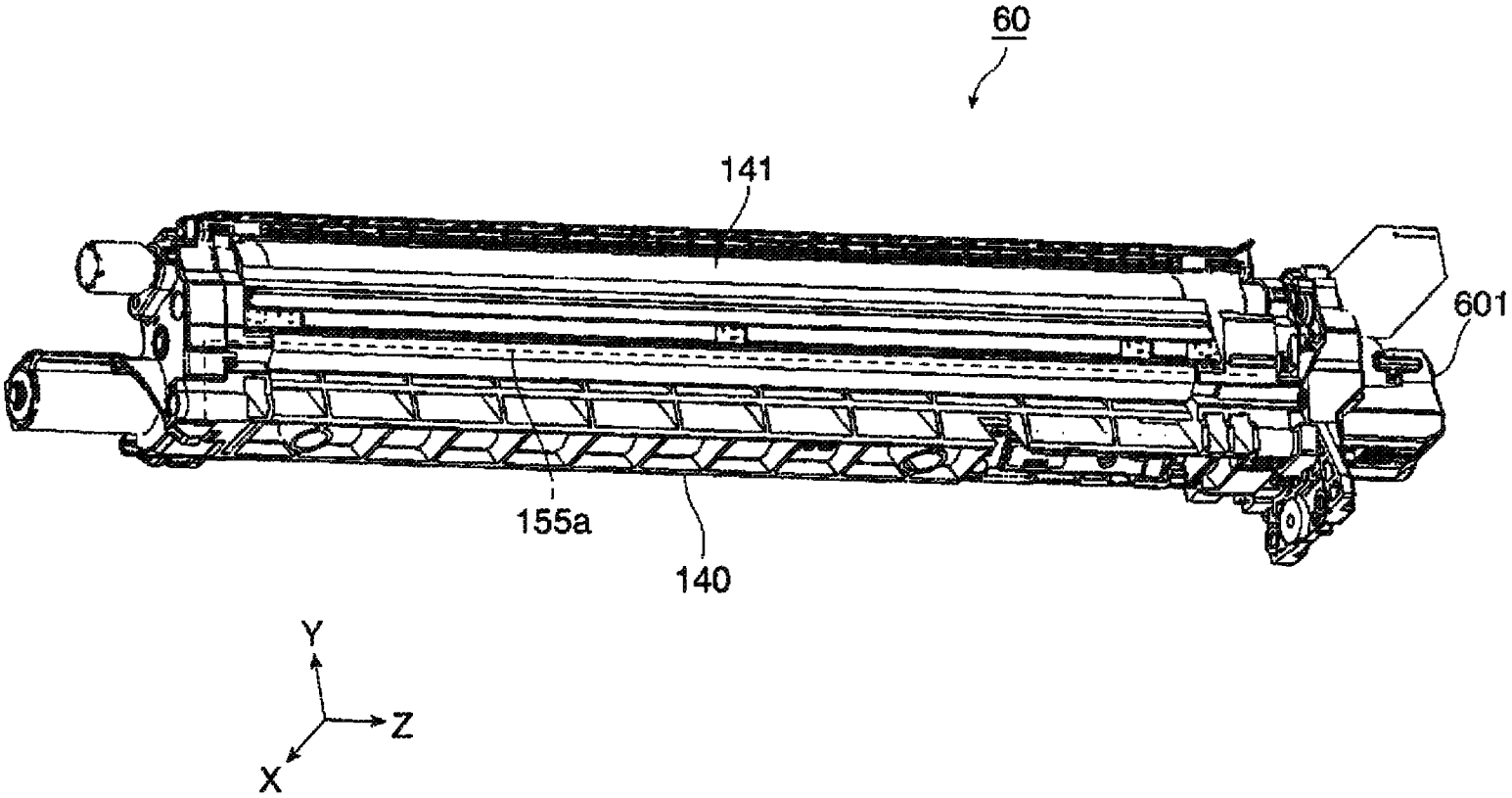
FIG. 13 is a perspective configuration view illustrating wiring of the developing unit.

In addition, in the end portion on the far side along the longitudinal direction of the developing unit 60, as illustrated in FIG. 11, an electrode 155 which includes a planar member made of metal, such as stainless steel, for conducting a developing bias to the developing device 14, when mounting the developing unit 60 on the image forming apparatus main body 1*a*, is provided to be adjacent to the near side along the mounting direction of the second convex portion 154. More specifically, in the end portion on the far side along the longitudinal direction of the housing 140 of the developing device 14, an electrode attaching portion 156 which is formed to be substantially the same as the second convex portion 154 is provided on the near side along the mounting direction of the second convex portion 154. As illustrated in FIG. 12A, the electrode attaching portion 156 has a recessed location 157 for attaching the electrode 155 which is positioned (recessed) above a lower end surface 154*a* of the second convex portion 154. The electrode 155 is fixed by a configuration member which is not illustrated of the developing device housing 140 in a state of being tightly adhered to the bottom surface (lower surface) of the recessed location 157. As illustrated by a dashed line in FIG. 13, after drawing out the electrode 155 to the photoconductor unit 50 side of the developing device housing 140, the electrode 155 extends to the near side along the mounting direction of the developing unit 60 along the lower end surface of the developing device housing 140, and is connected to the end portion along the shaft direction of the developing roll 141 via an electric circuit 155*a* that extends to the end portion on the near side along the longitudinal direction of the developing unit 60.

In addition, in the second convex portion 154, as illustrated in FIG. 12A, inclined surfaces 154*b* and 154*c* which come into contact with a pressing member 74 which will be described on the end surfaces on the near side and on the far side along the mounting direction of the developing unit 60, and act to push down the pressing member 74, are respectively provided. The electrode 155 is configured so that the pushed-down pressing member 74 comes into contact with the electrode 155 from below in a state of being disposed at a position more recessed below the lower end surface 154*a* of the second convex portion 154, and pushing down the pressing member 74 by the inclined surface 154*c* of the second convex portion 154 when mounting the developing unit 60. Therefore, in the electrode 155, even in a case where the developing unit 60 is repeatedly attached and detached, the force acting along the attaching and detaching direction of the developing unit 60 is reduced.

In addition, in the upper end portion of the housing 140 of the developing device 14, as illustrated in FIG. 10, the guide rail portion 150 which guides the photoconductor unit 50 toward the photoconductor unit 50 side is formed along the longitudinal direction. In the end portion on the far side of the guide rail portion 150, as illustrated in FIG. 11, an inclined portion 151 which avoids the contact with the projection portion 515 of the photoconductor unit 50, and allows the developing unit 60 to be displaced to the photoconductor unit 50 side, after mounting the photoconductor unit 50, is provided.

In addition, in the lower end portion of the holder member 601, as illustrated in FIGS. 7 and 8, the substantially triangular regulating plate section 611 is provided toward the photoconductor unit 50 side. The regulating plate section 611 abuts against the regulating plate section 509 of the photoconductor unit 50, and prevents the developing unit 60 from being mounted to the operation position, when the developing unit 60 is mistakenly mounted on the image forming apparatus main body 1*a* later by the photoconductor unit 50.

As illustrated in FIG. 3, after the developing unit 60 is mounted on the image forming apparatus main body 1*a*, the switching lever 603 rotates in the counterclockwise direction in the drawing, the end portion on the near side in the longitudinal direction of the housing 140 of the developing device 14 is pushed by the coil spring 606, the end portion on the far side in the longitudinal direction of the housing 140 of the developing device 14 is pushed by a coil spring 73 that configures the other biasing unit which will be described, and rotates using the second stud 113 and the rotating shaft 602 as a starting point, and the developing device 14 is positioned at the operation position. In the developing device 14, as illustrated in FIG. 9, the abutting members 152 including the bearing member or the like, are respectively provided in both end portions along the shaft direction of the developing roll 141. As the abutting member 152 of the developing device 14 abuts against the abutting members 516 (refer to FIG. 6) which similarly including the bearing member or the like and are provided in both end portions along the shaft direction of the photoconductor drum 11, the void (drum to roll space (DRS)) between the photoconductor drum 11 and the developing roll 141 is held to be a necessary value.

Exposure Unit

As illustrated in FIG. 1, the exposure unit includes the exposure device 13, and in the exemplary embodiment, since the photosensitive unit does not configure main portions, the description thereof will be omitted. In addition, as numeral references which illustrate the exposure unit, for convenience, the numeral reference 13 illustrating the exposure device is used.

Configuration of Characteristic Parts of Image Forming Apparatus.

Figure 14:
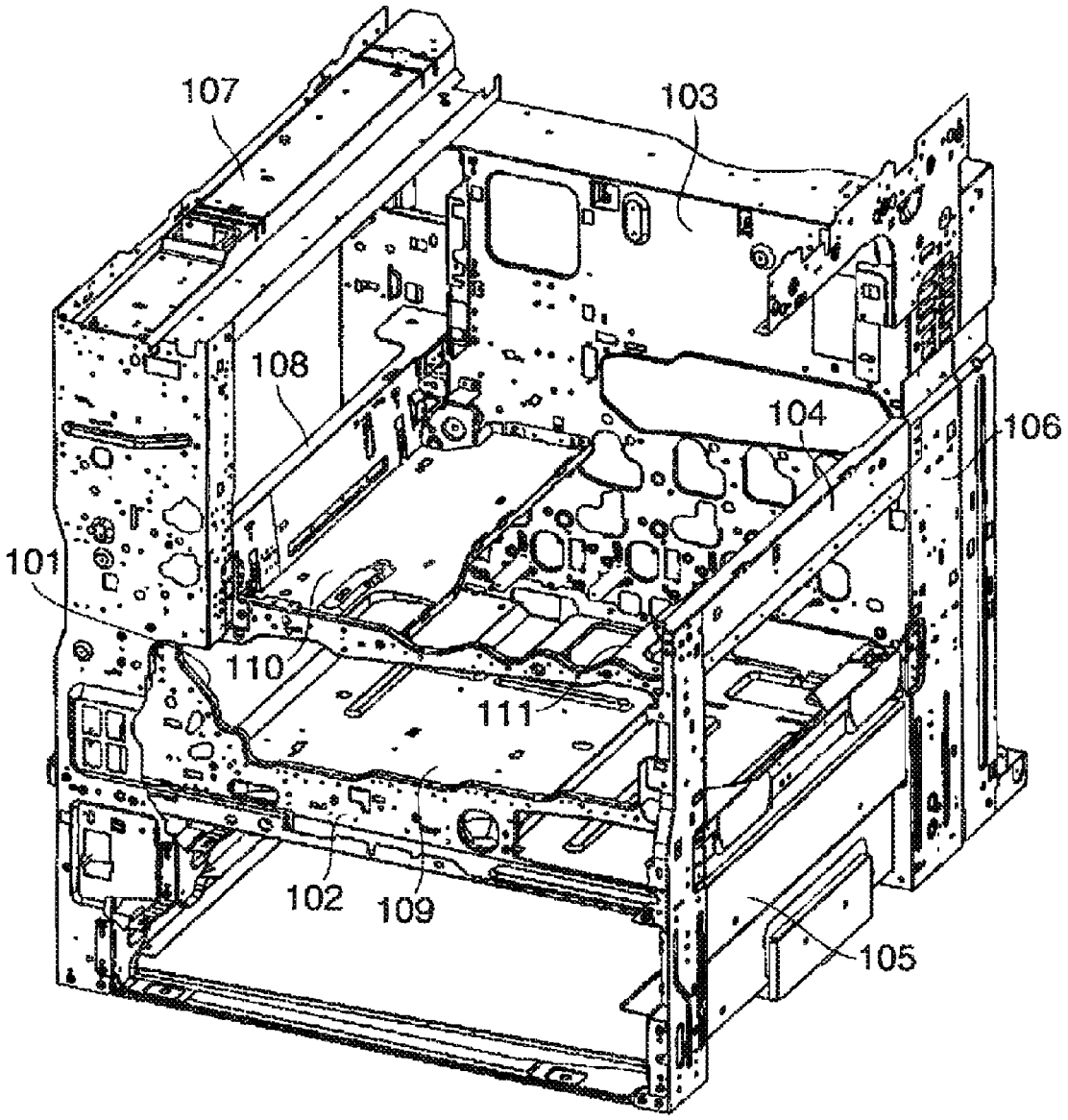
FIG. 14 is a perspective configuration view illustrating an apparatus main body of the image forming apparatus according to the first exemplary embodiment of the invention.

FIG. 14 is a perspective configuration view illustrating an apparatus main body of the image forming apparatus.

As illustrated in FIG. 14, the image forming apparatus main body 1*a* includes: a front frame 102 which is disposed on the front surface of the image forming apparatus 1, and has an opening portion 101 that forms a shape of a substantially rectangular parallelepiped for attaching and detaching the process cartridge 100 to and from the image forming apparatus main body 1*a*; a rear frame 103 which is disposed across substantially the entire surface on the back surface of the image forming apparatus 1, and has a positioning member or the like of the process cartridge 100; right side frames 104, 105, and 106 which are vertically disposed on a right side surface of the image forming apparatus 1, and link the front frame 102 and the rear frame 103; left side frames 107 and 108 which are disposed on a left side surface of the image forming apparatus 1, and link the front frame 102 and the rear frame 103; and a base frame 109 or intermediate frames 110 and 111 which are disposed to horizontally divide the inner space of the image forming apparatus 1.

Figure 15:
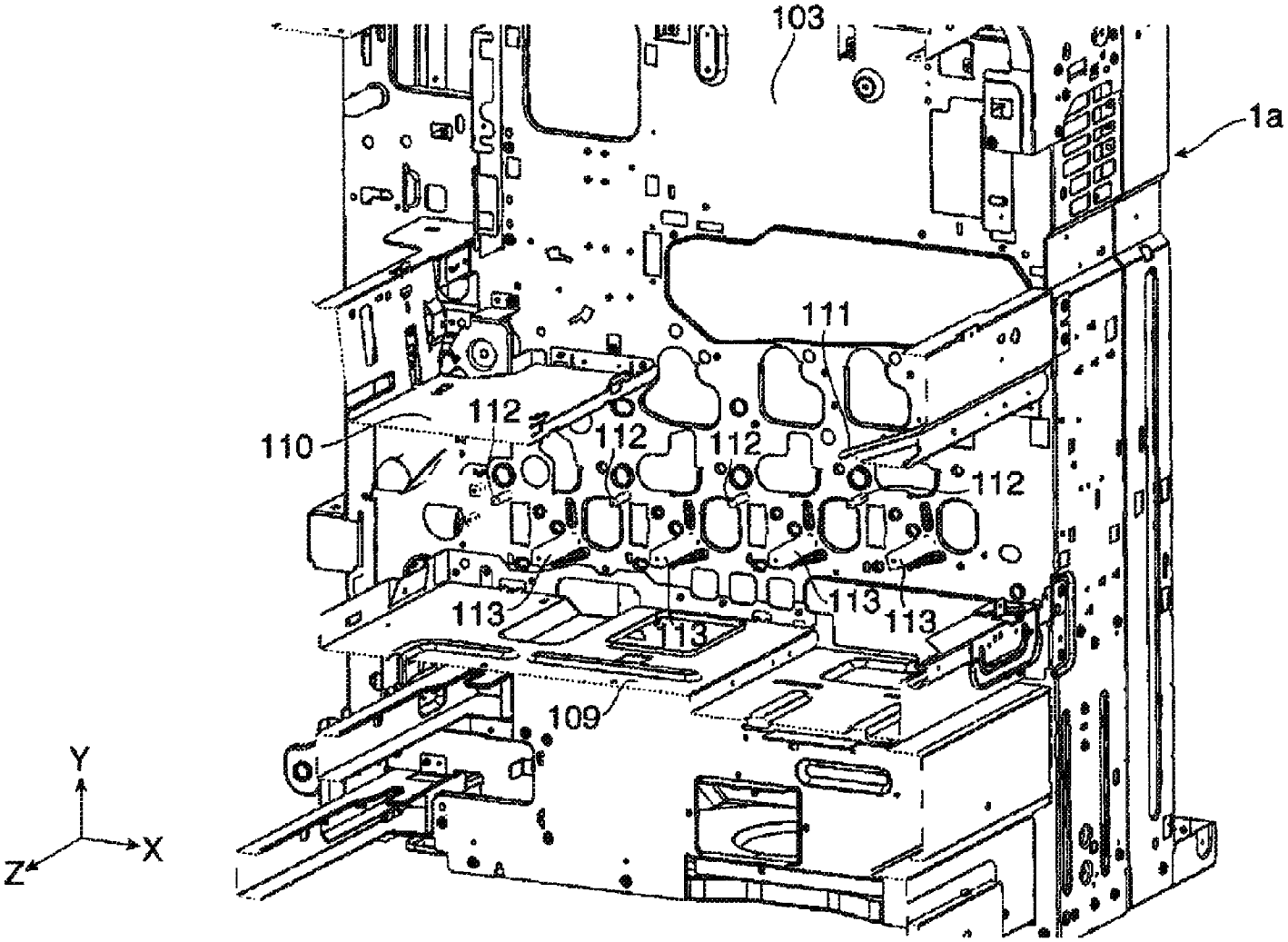
FIG. 15 is a perspective configuration view illustrating the apparatus main body of the image forming apparatus according to the first exemplary embodiment of the invention.

Each of the front frames 102 to 111 which configure the image forming apparatus main body 1*a* performs press processing with bending processing or stamping processing with respect to sheet metal, and are bonded to each other by welding or fastening the press-processed sheet metal as necessary, and accordingly, are combined with each other as a frame body having a shape of a substantially rectangular parallelepiped. Various members or components which configure the image forming apparatus 1 are mounted on each of the front frames 102 to 111 to be in a fixed state or to be detachably attached. In the rear frame 103, as illustrated in FIG. 15, four first studs 112 which are positioned by inserting the positioning portion 513 (refer to FIG. 6) provided in the end portion on the far side along the mounting direction of each photoconductor unit 50 (Y, M, C, K), and four second studs 113 which are positioned by inserting the positioning hole 146 (refer to FIG. 9) provided in the end portion on the far side along the mounting direction of each developing unit 60 (Y, M, C, K), are respectively provided to protrude toward the inner side of the image forming apparatus main body 1*a* at positions which correspond to each photoconductor unit 50 (Y, M, C, K) and each developing unit 60 (Y, M, C, K).

Figure 16:
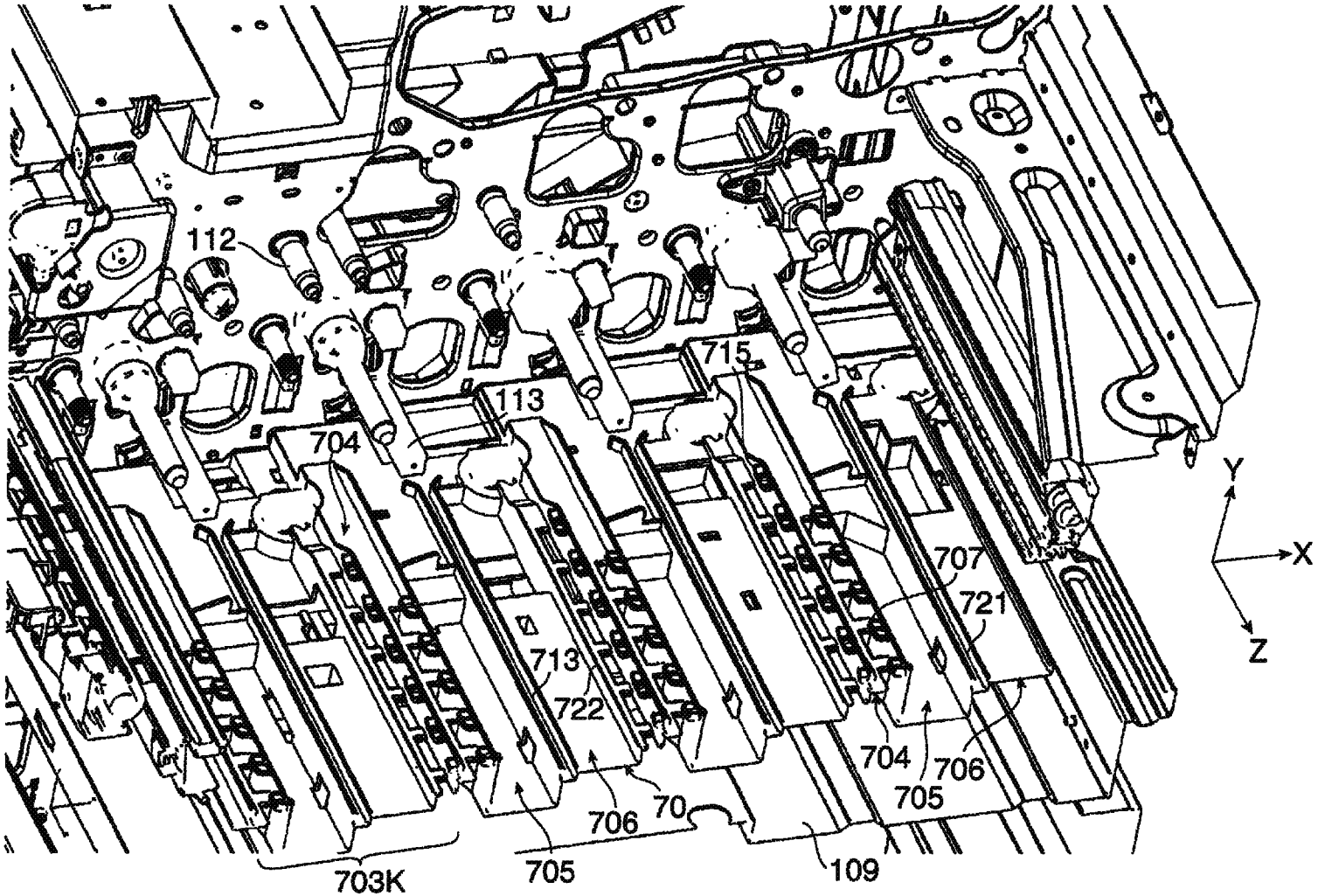
FIG. 16 is a perspective configuration view illustrating main portions of the image forming apparatus according to the first exemplary embodiment of the invention.

In addition, above the base frame 109 of the image forming apparatus main body 1*a*, as illustrated in FIG. 16, an insertion guide member 70 which is an example of the guide member is mounted via a necessary void. When mounting the photoconductor unit 50, the developing unit 60 and the exposure unit 13 on the image forming apparatus main body 1*a*, the insertion guide member 70 is a member which guides the photoconductor unit 50, the developing unit 60, and the exposure unit 13 along the Z direction which is the attaching and detaching (inserting and extracting) direction.

Figure 17:
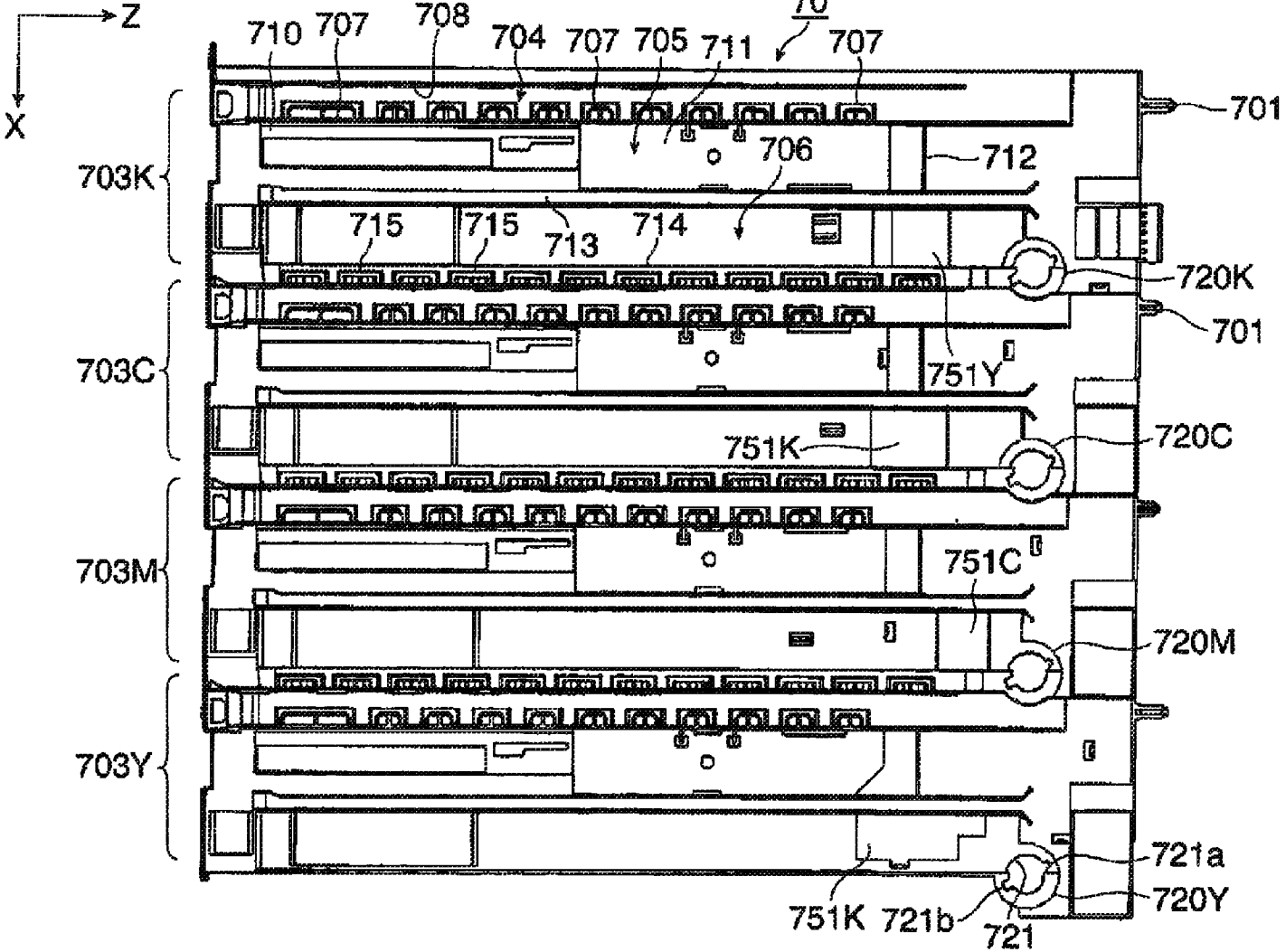
FIG. 17 is a plan configuration view illustrating an insertion guide member.
Figure 18:
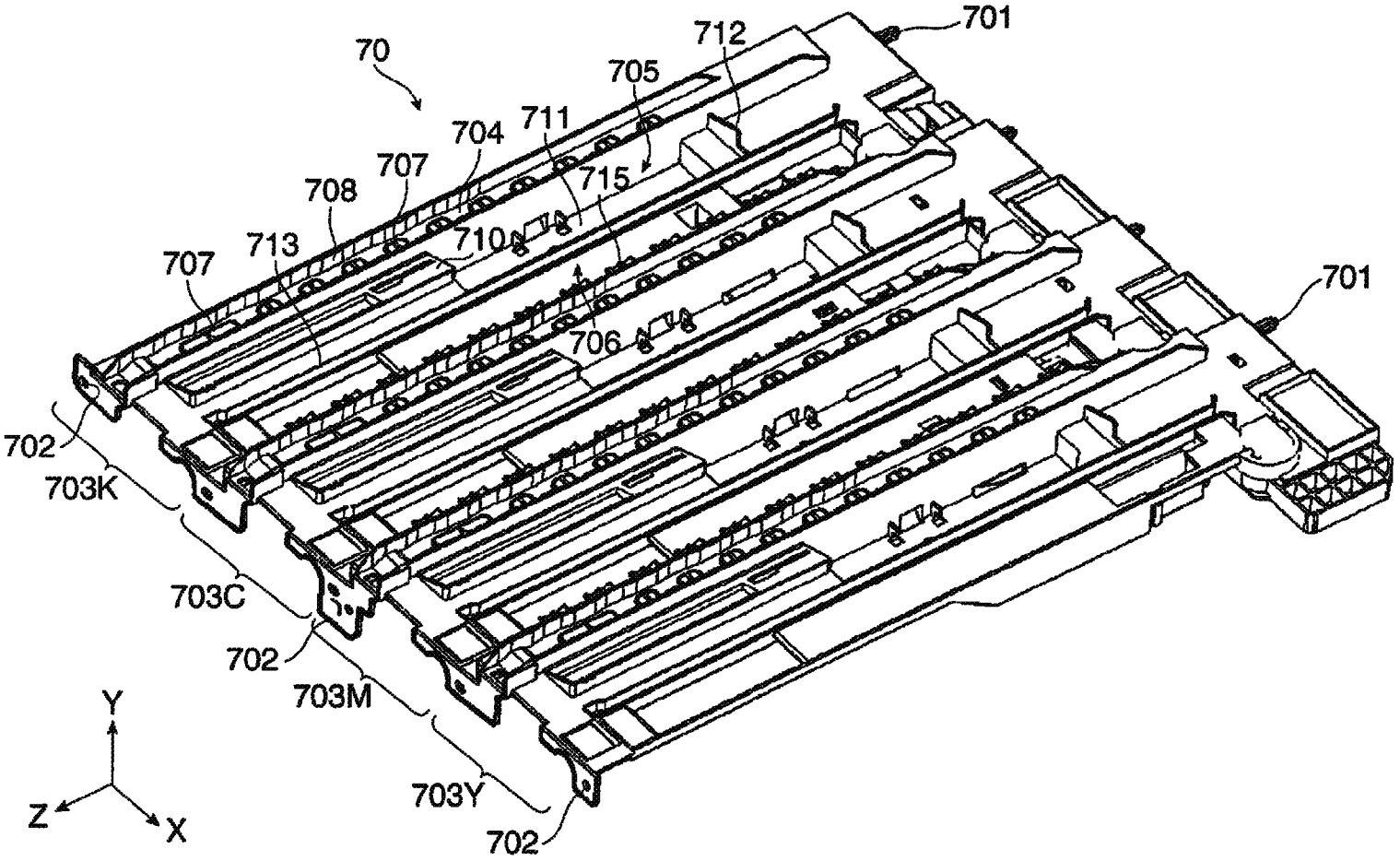
FIG. 18 is a perspective configuration view illustrating the insertion guide member.

As illustrated in FIGS. 17 and 18, the insertion guide member 70 is made of a synthetic resin which is integrally formed by injection forming or the like, and is formed in a shape of a base plate which has a substantially rectangular plane shape and has a necessary height along the vertical direction (Y direction). The insertion guide members 70 are respectively inserted into the plural positioning holes which is not illustrated and in which plural boss portions 701 provided to protrude to the end surface on the back surface side is open to the rear frame 103, and by screwing the plural attaching holes 702 (refer to FIG. 18) provided on the end surface on the front surface side to the front frame 102, the insertion guide member 70 is attached in a fixed state to be horizontally positioned on the upper portion of the base frame 109 of the image forming apparatus main body 1*a*.

The insertion guide member 70 includes four insertion guide portions 703 (Y, M, C, K) which extends along the attaching and detaching direction (Z direction) of the process cartridge 100, corresponding to each image forming device 10 (Y, M, C, K) of yellow (Y), magenta (M), cyan (C), and black (K) colors. As illustrated in FIG. 1, each image forming device 10 (Y, M, C, K) is disposed to be inclined so that the image forming device 10Y side of yellow (Y) color is relatively high and the image forming device 10K side of black (K) color is relatively low. Therefore, each insertion guide portion 703 (Y, M, C, K) is disposed to be in a shape of steps having a level difference so that the insertion guide portion 703Y of yellow (Y) color is relatively high and the insertion guide portion 703K of black (K) color is relatively low similar to each image forming device 10 (Y, M, C, K).

Each insertion guide portion 703 (Y, M, C, K) is configured basically in a similar manner. As illustrated in FIGS. 16 to 18, each insertion guide portion 703 (Y, M, C, K) is provided with a photoconductor unit guide 704 which is disposed to be one step higher in the end portion on the left side along the width direction (X direction) intersecting the mounting direction (Z direction) of the process cartridge 100, and guides the lower end portion of the photoconductor unit 50, a exposure unit guide 705 which is disposed in the center portion along the width direction (X direction) of the insertion guide portion 703 (Y, M, C, K), and guides the exposure unit 13, and a developing unit guide 706 which is disposed in the end portion on the right side along the width direction (X direction) of the insertion guide portion 703 (Y, M, C, K), and guides the lower end portion of the developing unit 60.

The photoconductor unit guide 704 is formed in a shape of a recessed guide which guides the guide portion 504 provided in a shape having a substantially T-shaped section downward to the lower end portion of the photoconductor unit 50. In the upper end portion on one side (right side in the drawing) of the photoconductor unit guide 704, a regulating plate 707 which regulates the movement to the upper part of the guide portion 504 is provided in a state of being divided into plural pieces along the mounting direction (Z direction) to protrude to the upper portion of the recessed groove. In addition, on the side surface on the other side (left side in the drawing) of the photoconductor unit guide 704, an uneven surface 708 (refer to FIG. 18) for reducing the contact resistance by reducing the contact area with the guide portion 504 of the photoconductor unit 50, is formed. The uneven surface 708 is disposed across from the end portion on the near side to the intermediate portion along the mounting direction (Z direction) of the photoconductor unit 50.

In addition, the exposure unit guide 705 includes: a loading table 710 which is one step higher on the near side along the mounting direction (Z direction) of the exposure unit 13, and is fixed to load the exposure unit 13 provided in a state of being inclined toward the photoconductor drum 11 side; a recessed location 711 which is formed on the far side along the mounting direction (Z direction), and accommodates a flexible flat cable (FFC) or the like which is not illustrated and is connected to the exposure unit 13; and a loading plate 712 which is formed in the end portion on the far side along the mounting direction (Z direction), and is fixed to load the end portion on the far side of the exposure unit 13 similar to the loading table 710.

The developing unit guide 706 includes: a guide groove 713 which guides the first convex portion 153 in a state where the first convex portion 153 (refer to FIG. 2) provided to protrude downward is inserted into the end portion on the photoconductor unit 50 side in the lower end portion of the developing device 14; and a guiding surface 714 which guides the second convex portion 154 provided in the end portion opposite to the photoconductor unit 50 in the lower end portion of the developing device 14. In the upper end portion on one side (right side in the drawing) of the guiding surface 714, a regulating plate 715 which regulates the movement to the upper part of the second convex portion 154 is provided in a state of being divided to be plural pieces along the mounting direction (Z direction) to protrude to the upper portion of the guiding surface 714. In addition, in the developing unit guide 706, since the developing unit 60 of yellow color is regulated by another regulating member which is not illustrated, the regulating plate 715 is not provided.

As illustrated in FIG. 17, the insertion guide member 70 includes a mounting portion 720 (Y, M, C, K) on which a biasing unit 72 (refer to FIG. 19) which biases the end portion on the far side of the developing unit 60 (Y, M, C, K) toward the upper part of the vertical direction (Y direction), in the end portion on the far side along the mounting direction (Z direction) of each developing unit 60 (Y, M, C, K). In the mounting portion 720 (Y, M, C, K), an insertion hole 721 having a substantially circular plane in which the pressing member 74 that configures the biasing unit 72 is inserted, is provided.

Figure 19:
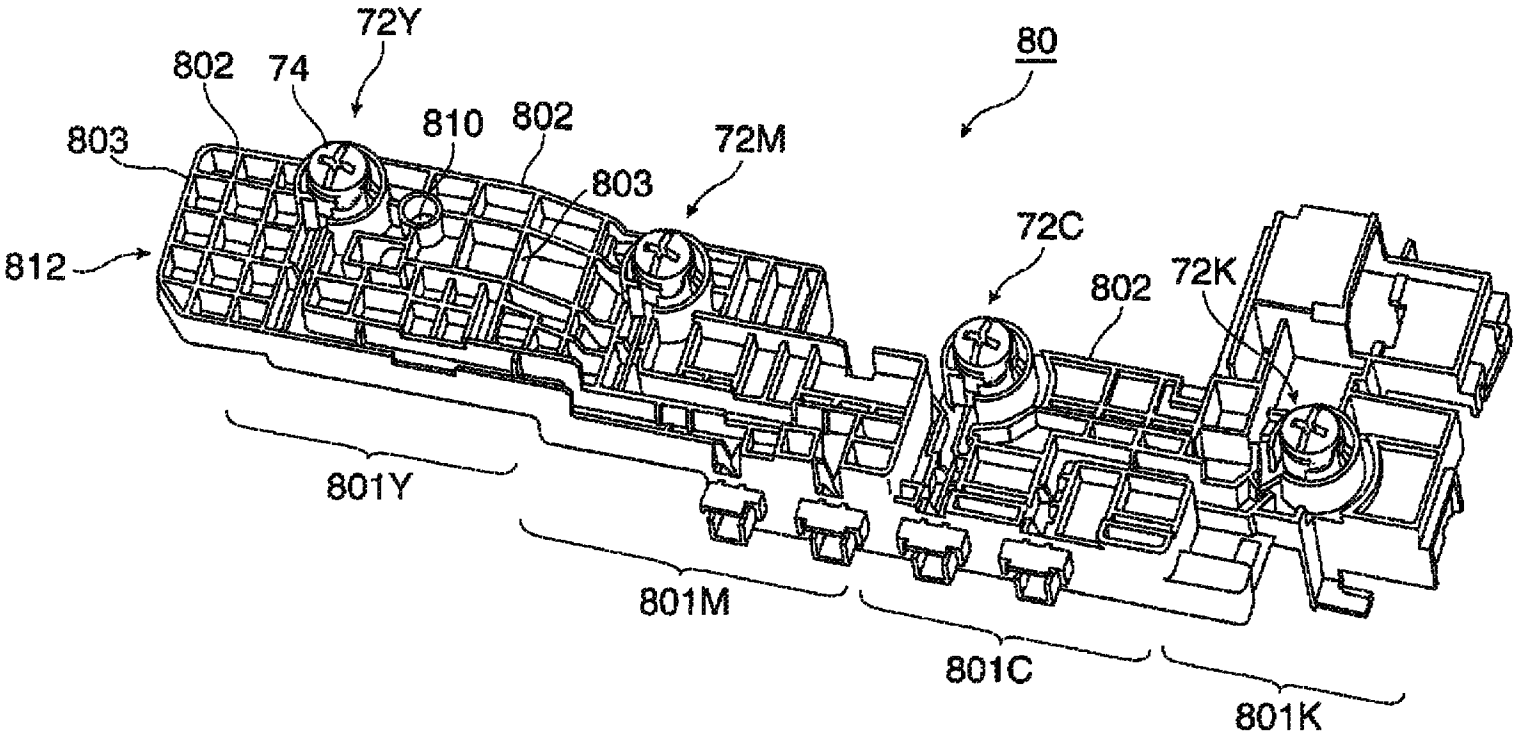
FIG. 19 is a perspective configuration view illustrating a holding member.
Figure 20:
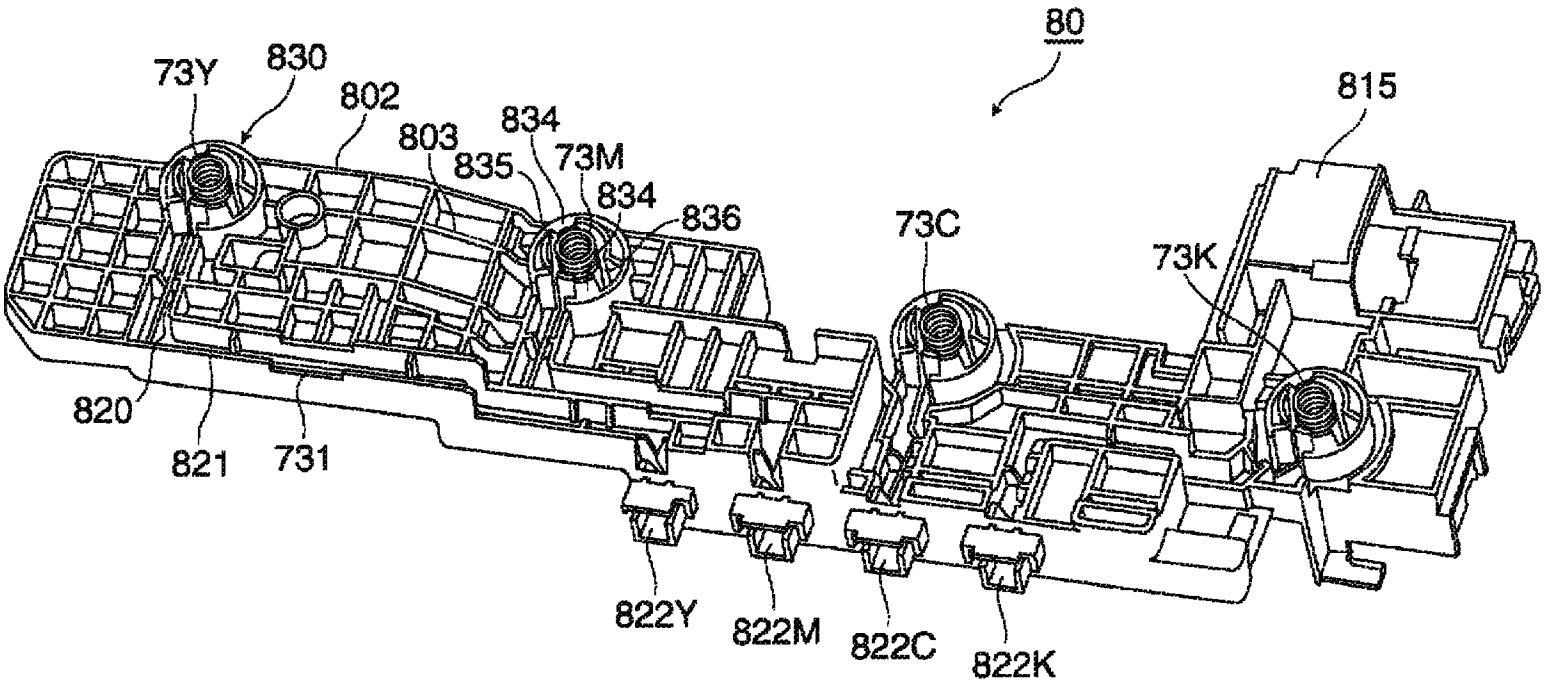
FIG. 20 is a perspective configuration view illustrating the holding member.

As illustrated in FIGS. 19 and 20, the biasing unit 72 (Y, M, C, K) includes the coil spring 73 which is an example of the biasing member that biases the developing device 14 of each developing unit 60 toward the upper part of the vertical direction (Y direction), and the pressing member 74 which is mounted at the tip end of the coil spring 73 and directly presses the developing device 14. The coil spring 73 and the pressing member 74 are held by a holding member 80 which is mounted on the end portion on the far side on the back surface of the insertion guide member 70.

As illustrated in FIG. 19, the holding member 80 is integrally formed in a shape of a base plate having a substantially rectangular plane shape which is elongated along the width direction (X direction) by an insulating synthetic resin. The holding member 80 has four holding portions 801 (Y, M, C, K) which respectively corresponds to each image forming device 10 (Y, M, C, K) of yellow (Y), magenta (M), cyan (C), and black (K) colors. Similar to the insertion guide portions 703 (Y, M, C, K) of the insertion guide member 70, four holding portions 801 (Y, M, C, K) are formed in a shape of steps having a level difference so that the holding portion 801Y which corresponds to the image forming device 10Y of yellow (Y) color is relatively high, and the holding portion 801K which corresponds to the image forming device 10K of black (K) color is relatively low.

The holding member 80 receives a pressing force as a reaction force when pressing the developing device 14 by an elastic force of the coil spring 73. On the front surface of the holding member 80, plural reinforcing ribs 802 and 803 which are disposed in a grid pattern or in parallel across the outer circumference and the inner circumference of each holding portion 801 (Y, M, C, K), are provided. As a result, the rigidity of the holding member 80 is enhanced by the plural reinforcing ribs 802 and 803.

Figure 21:
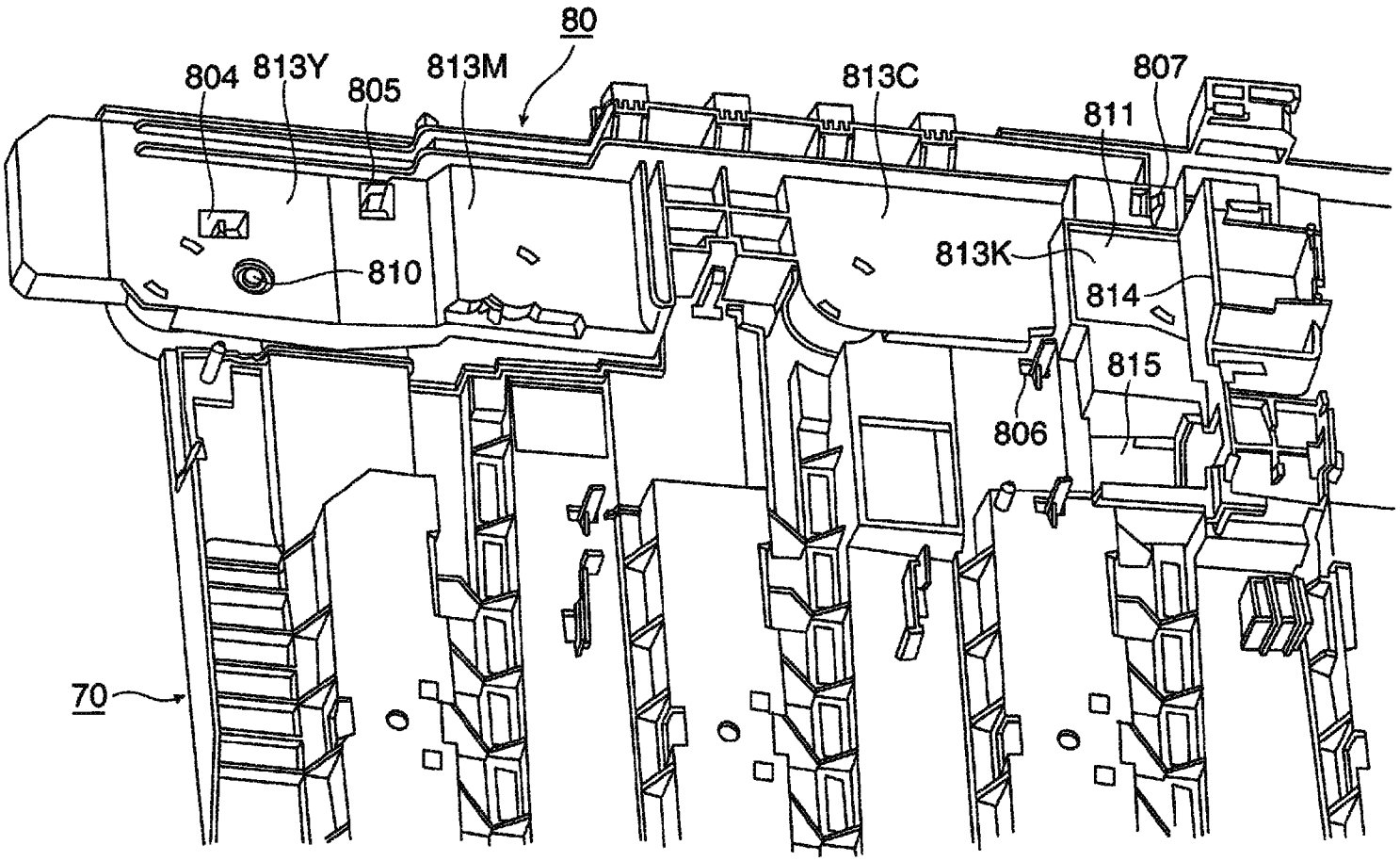
FIG. 21 is a perspective configuration view illustrating a back surface side where the holding member is mounted on the insertion guide member.
Figure 22:
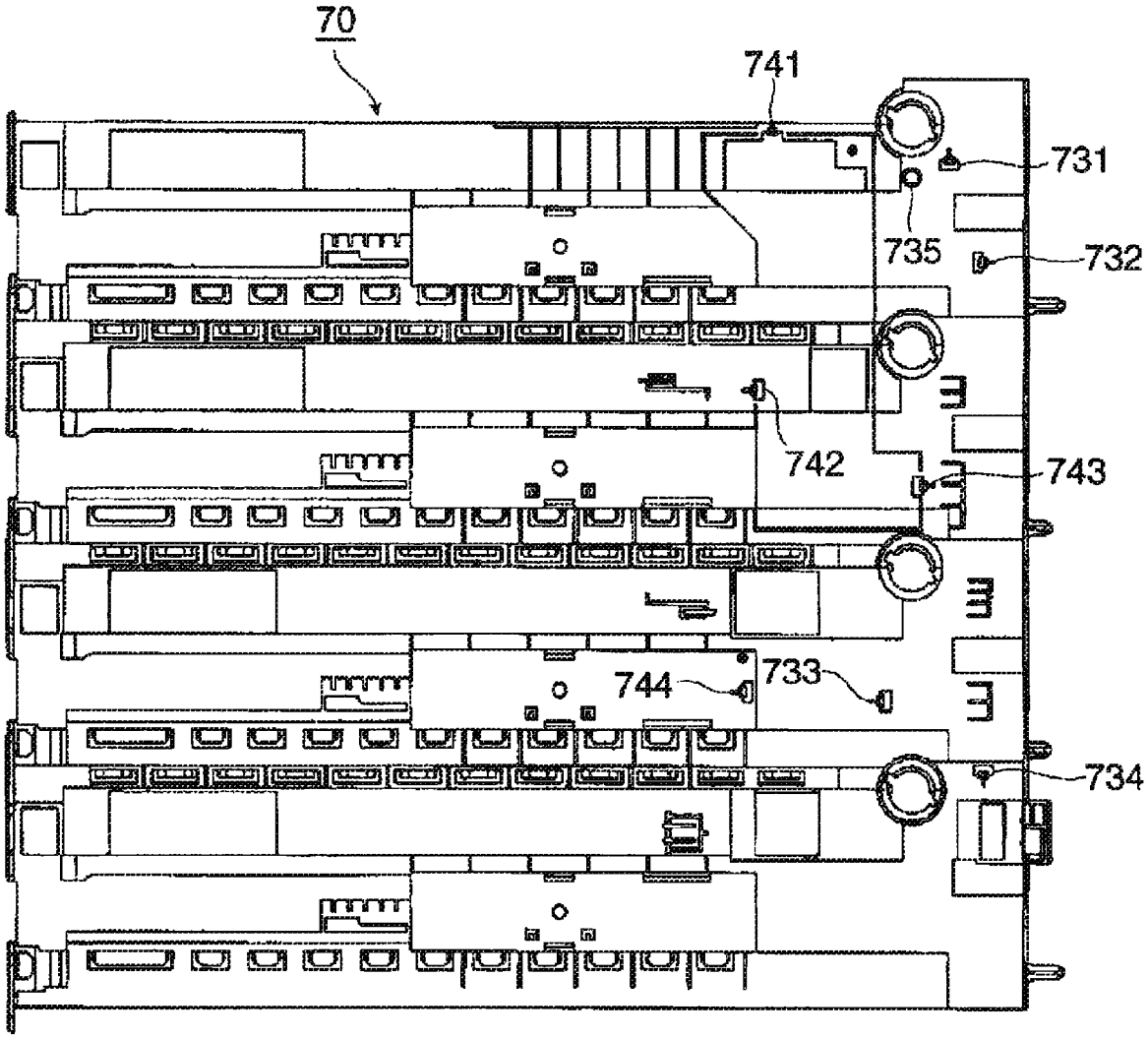
FIG. 22 is a back surface configuration view illustrating the insertion guide member.
Figure 23:
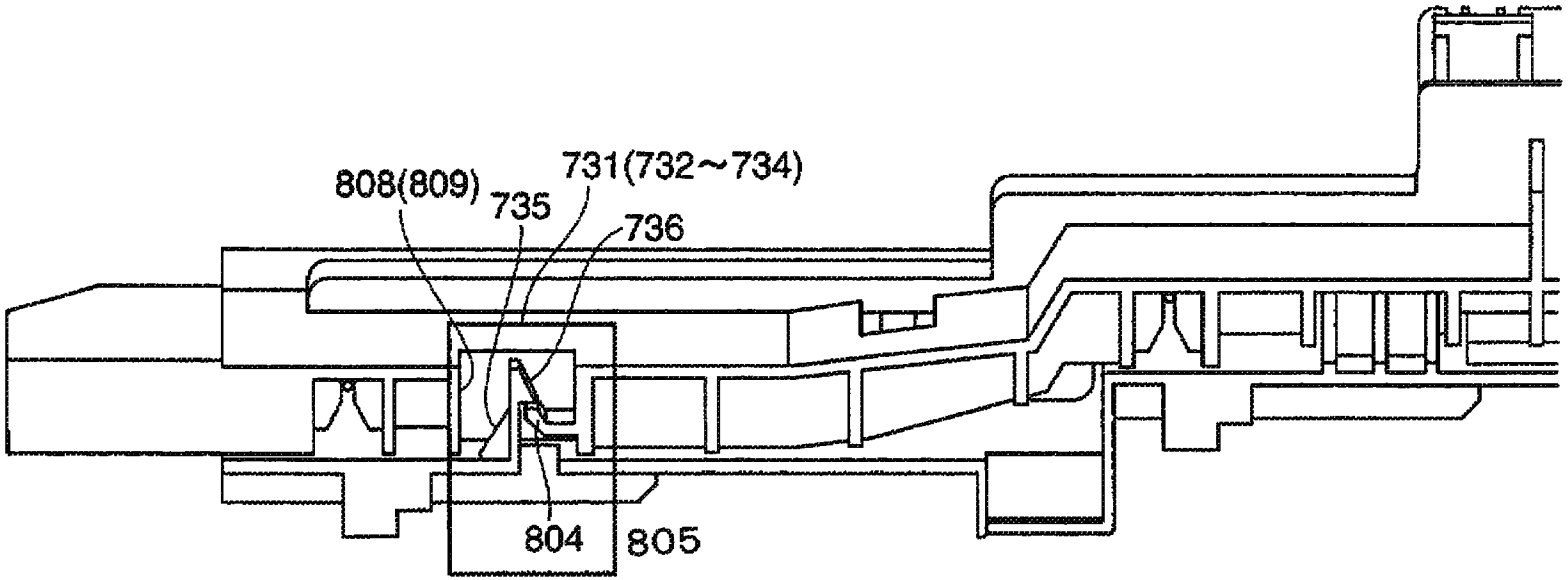
FIG. 23 is a sectional perspective view illustrating a state where the holding member is mounted on the insertion guide member.

As illustrated in FIG. 21, the holding member 80 is mounted on the back surface of the end portion on the far side along the mounting direction (Z direction) of the process cartridge 100 of the insertion guide member 70, by a snap-fit method. On the back surface of the insertion guide member 70, as illustrated in FIG. 22, four snap-fit portions 731 to 734 are provided to protrude downward in the vertical direction. As illustrated in FIG. 23, four snap-fit portions 731 to 734 are configured basically similar to the snap-fit portion 731. The snap-fit portion 731 includes an engaging piece 735 which is integrally provided in a flat plate shape to protrude downward on the back surface of the insertion guide member 70, and is elastically deformable, and a convex portion 736 (engaging portion) provided in a shape having a substantially right-angled triangular section, at the tip end of the engaging piece 735.

In addition, in the holding member 80, as illustrated in FIG. 21, at a position which corresponds to the snap-fit portions 731 to 734 of the insertion guide member 70, engaging portions 804 to 807 which are engaged with the convex portion 736 of the engaging piece 735, are provided. As illustrated in FIG. 23, four engaging portions 804 to 807 are basically configured similar to the engaging portion 804. In the present exemplary embodiment, the engaging portion 804 is formed in a flat plate shape including an inclined portion which is included in the same direction as that of the convex portion 736 of the snap-fit portion 731 at the tip end, in order to make it easy to be engaged with the convex portion 736 by promoting an elastic deformation of the engaging piece 735 of the snap-fit portion 731. In addition, the engaging portions 804 to 807 may be formed in a simple flat plate shape with which the convex portion 736 of the snap-fit portions 731 to the 734 is engaged. In addition, in a state where the holding member 80 is mounted on the insertion guide member 70, a necessary void which is equal to or greater than 1 mm is set to be formed between the convex portion 736 of the engaging piece 735 of the insertion guide member 70 and the tip end surface of the engaging portions 804 to 807 of the holding member 80. Therefore, the holding member 80 is mounted in a state of having a free end which corresponds to the void along the vertical direction (Y direction) with respect to the insertion guide member 70 fixed to the image forming apparatus main body 1*a*.

In addition, among the engaging portions 804 to 807 of the holding member 80, the engaging portions 804 and 805 are provided not in the end portion of the holding member 80 but on the inside of the holding member 80. Therefore, in the holding member 80, as illustrated in FIG. 23, opening portions 808 and 809 for making the snap-fit portions 731 and 732 of the insertion guide member 70 engaged with the engaging portions 804 and 805 are formed.

In addition, as illustrated in FIG. 21, the holding member 80 is provided with two positioning portions 810 and 811 for positioning the holding member 80 with respect to the insertion guide member 70. As illustrated in FIG. 22, one positioning portion 810 is provided with a long hole (insertion hole) into which the cylindrical portion 735 provided to protrude downward on the back surface of the insertion guide member 70, is inserted. In addition, the other positioning portion 811 includes the pressing member 74 of the holding member 80 which is inserted into an insertion hole 721K that corresponds to black color of the insertion guide member 70. The insertion hole 721K which corresponds to black color of the insertion guide member 70 has an inner diameter which corresponds to the outer diameter of the pressing member 74 mounted on the holding member 80, and by inserting the pressing member 74 into the insertion hole 721K, the insertion guide member 70 and the holding member 80 are positioned.

Figure 24:
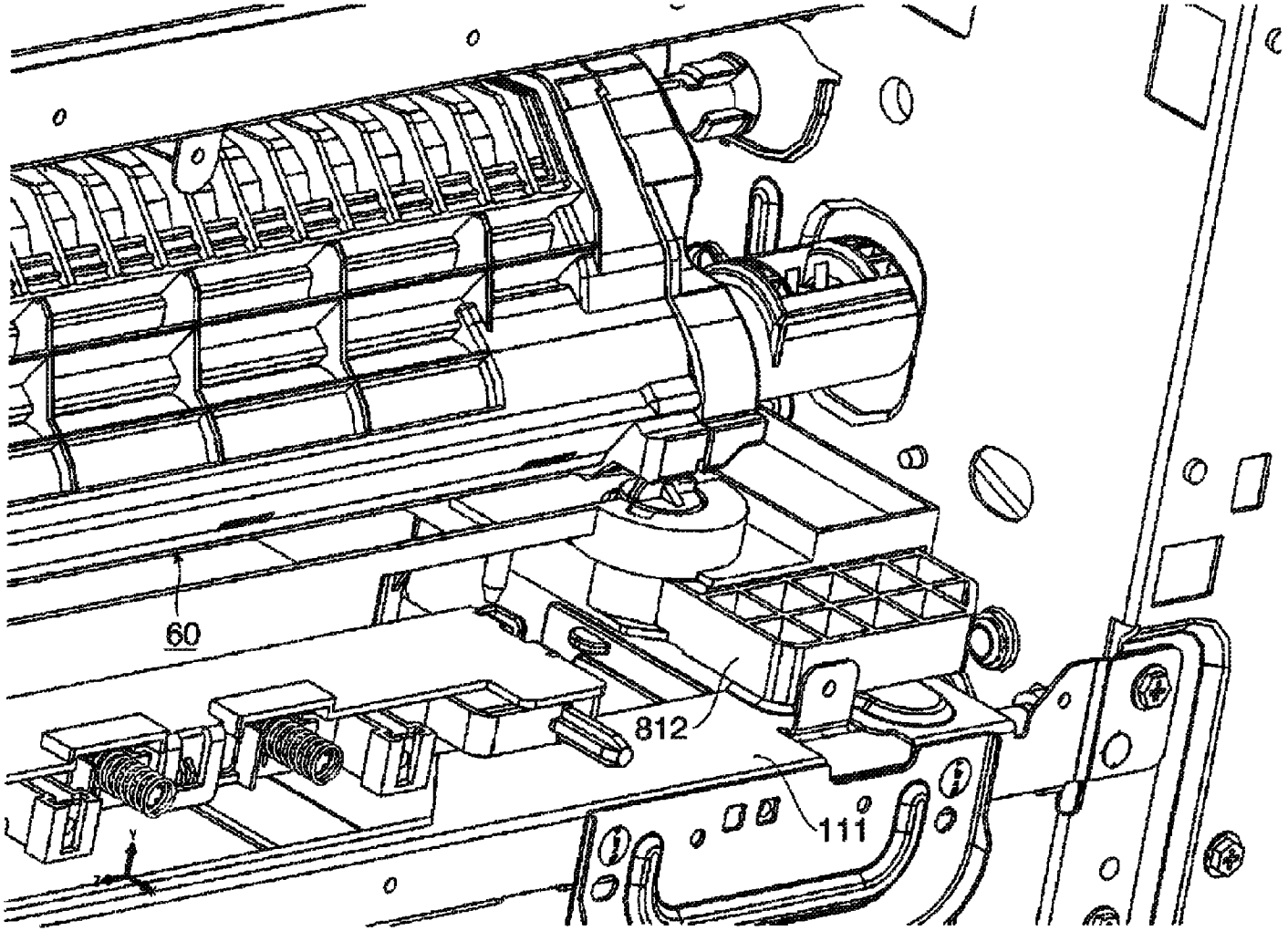
FIG. 24 is a perspective configuration view illustrating the main portions of the image forming apparatus according to the first exemplary embodiment of the invention.

In addition, as illustrated in FIG. 19, the holding member 80 has an abutment portion 812 having a substantially rectangular plane shape which is provided with the reinforcing ribs 802 and 803 having a grid pattern in the end portion on the outer side along the longitudinal direction of the holding portion 801Y of yellow (Y) color. As illustrated in FIG. 24, the abutment portion 812 is directly supported by the image forming apparatus main body 1*a* as the back surface thereof comes into contact with the intermediate frame 111 of the image forming apparatus main body 1*a*. In addition, a part of the intermediate frame 111 is raised in an elliptical shape, and the rigidity of the intermediate frame 111 is enhanced. The abutment portion 812 comes into contact with the flat front surface of the raised intermediate frame 111.

On the back surface of the holding member 80, as illustrated in FIG. 21, a region 813 (Y, M, C, K) formed in a flat plate shape corresponding to four holding portions 801 (Y, M, C, K), is formed. In addition, on the back surface of the holding portion 801K which corresponds to black color of the holding member 80, as illustrated in FIG. 25, a supporting plate section 814 having a flat plate shape which directly comes into contact with the base frame 109 of the image forming apparatus main body 1*a* and supports the holding member 80, is provided to protrude the most to the back surface side in the vicinity of the holding portion 801K of black color.

In addition, in the holding member 80, as illustrated in FIG. 20, on the near side along the mounting direction of the holding portion 801K of black color, a duct portion 815 which configures a part of an air duct member which will be described later, is provided.

Figure 25:
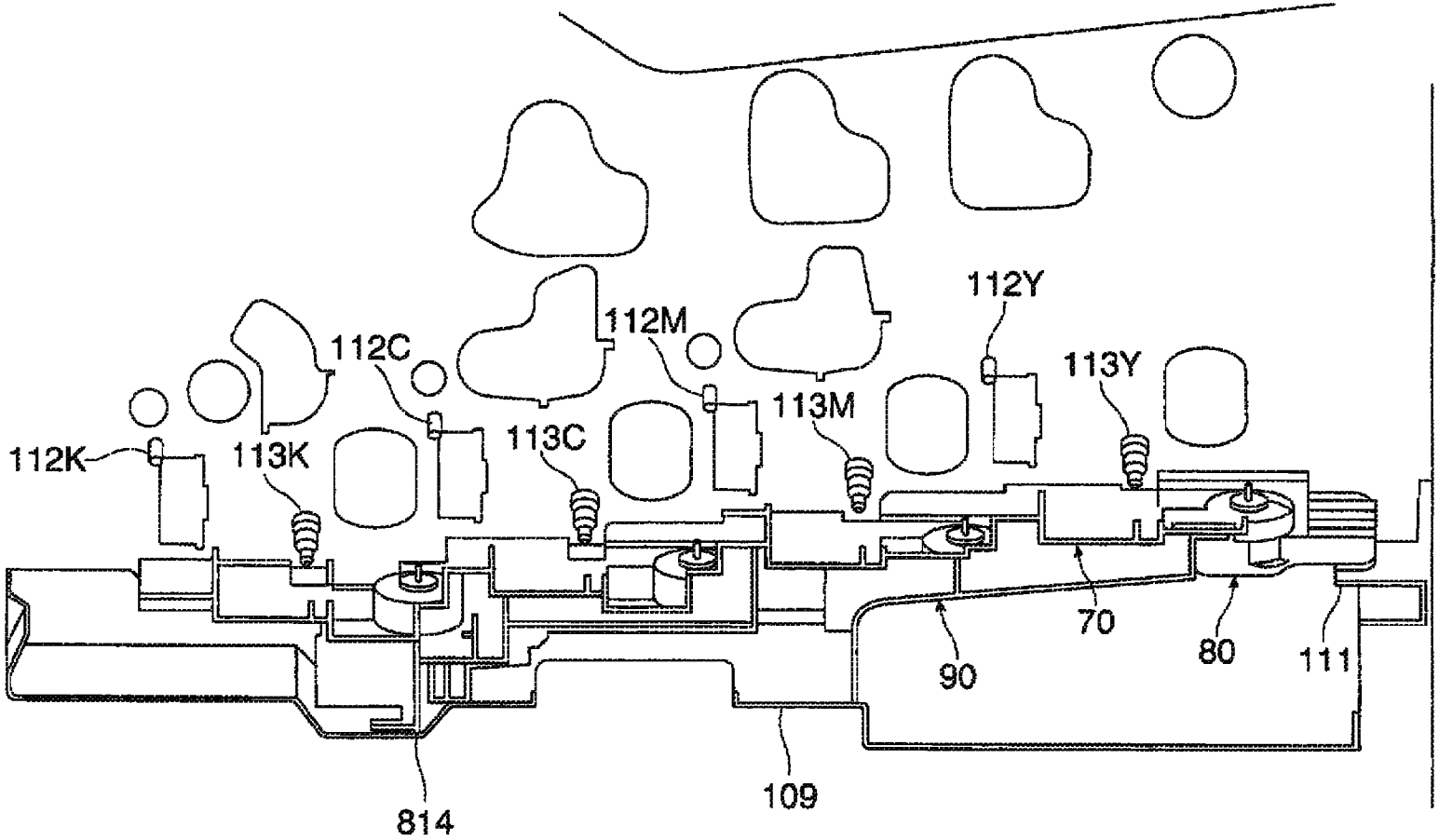
FIG. 25 is a perspective configuration view illustrating the main portions of the image forming apparatus according to the first exemplary embodiment of the invention.
Figure 26:
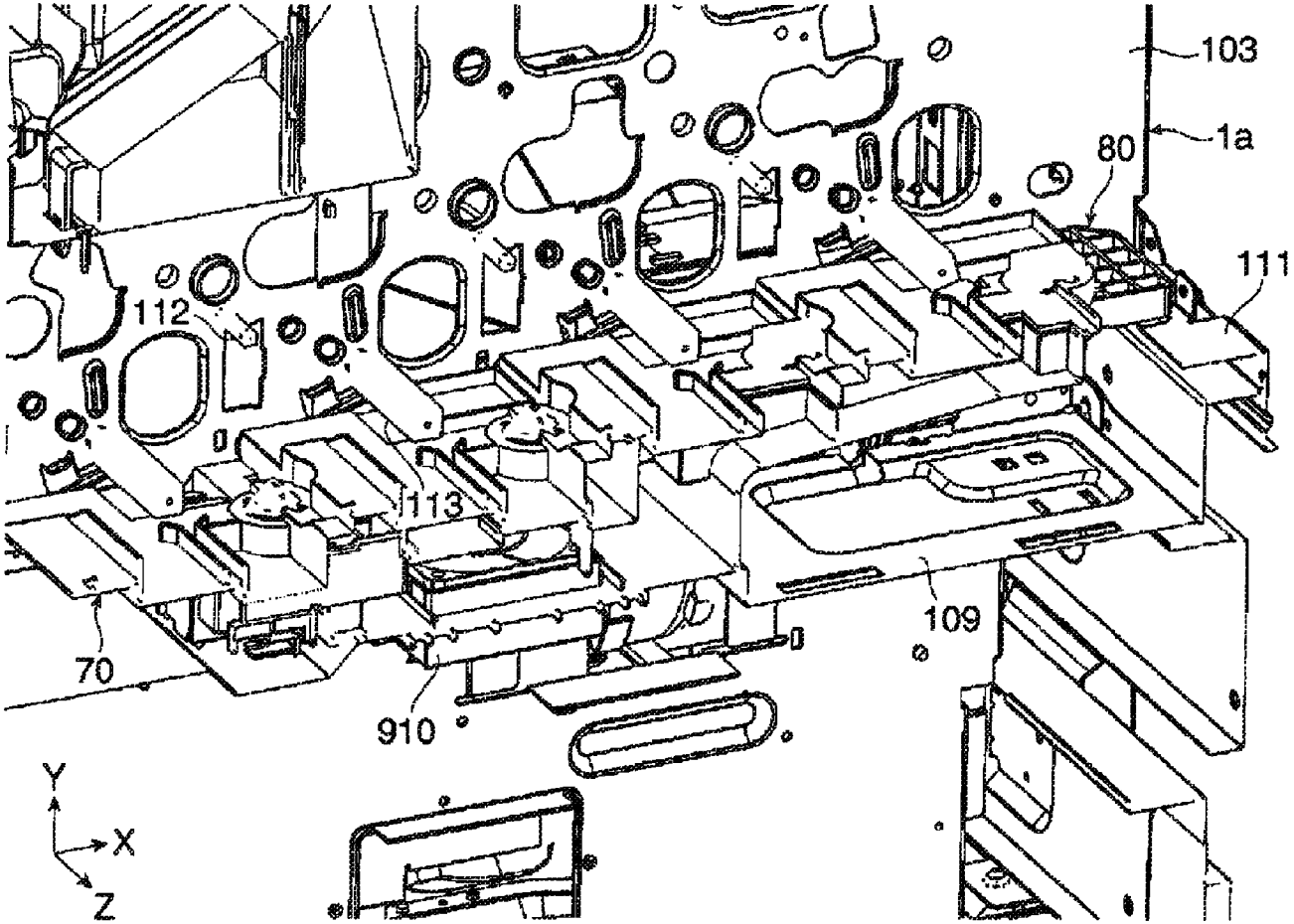
FIG. 26 is a perspective configuration view illustrating the main portions of the image forming apparatus according to the first exemplary embodiment of the invention.

In addition, on the back surface of the holding member 80, as illustrated in FIGS. 25 and 26, in a state of being mounted on the image forming apparatus main body 1*a* via the insertion guide member 70, the region 813C which corresponds to the holding portion 801C of cyan color is in contact with the base frame 109 via an air duct member 90 which will be described later as an example of another member. In other words, the region 813C which corresponds to the holding portion 801C of cyan color of the holding member 80 is in contact with the base frame 109 via the air duct member 90.

As illustrated in FIG. 20, the coil spring 73 (Y, M, C, K) forms a metal wire which is made of stainless steel or the like and has rigidity in a spiral shape having a necessary diameter. In the coil spring 73 (Y, M, C, K), the wiring member 731 which forms the electric circuit that applies developing bias voltage to the developing device 14 is integrally formed. In other words, the metal wire which configures the coil spring 73 has the wiring member 731. On the front surface of the holding member 80, a wire path 821 which is configured so that the wiring member 731 provided with a cutout portion 820 at a part of the reinforcing ribs 802 and 803 is capable of being inserted, is provided. The wiring member 731 and the wire path 821 are respectively provided corresponding to each coil spring 73 (Y, M, C, K) of yellow (Y), magenta (M), cyan (C), and black (K) colors. The end portions of the wiring member 731 (Y, M, C, K) are respectively connected to a conduction portion 822 (Y, M, C, K) provided in the end portion on the back surface side of the holding member 80. The conduction portions 822 (Y, M, C, K) are respectively connected to a high-voltage power source which is not illustrated and applies the developing bias voltage to the developing device 14 (Y, M, C, K). In addition, it is needless to say that the wire may be used as the wiring member 731. However, in the present exemplary embodiment, in order to further reduce the number of components, the same wire which configures the coil spring 73 serves as the wiring member.

Figure 27:
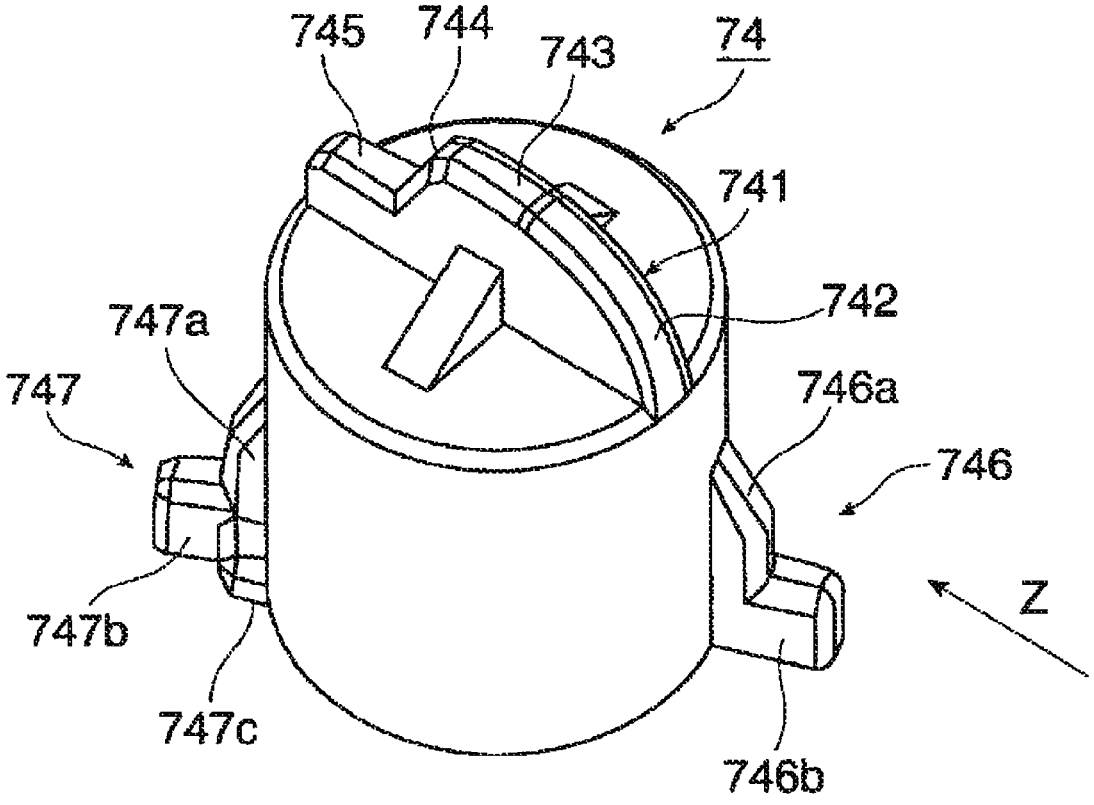
FIG. 27 is a perspective configuration view illustrating a pressing member.

As illustrated in FIG. 27, the pressing member 74 is integrally formed in a substantially cylindrical shape in which the upper end surface is blocked by the synthetic resin (for example, conductive POM) having conductivity and the lower end surface is open. On the upper end surface of the pressing member 74, a contact portion 741 which is in contact with the developing device 14 and presses the developing device 14, and conducts the developing bias voltage to the developing device 14 and has a thick flat plate shape, is provided. The rotation of the pressing member 74 in the circumferential direction is regulated in a state where the contact portion 741 is oriented to the same direction as the mounting direction (Z direction) of the developing unit 60, and is mounted on the holding member 80 in a state where the protrusion upward by the biasing force of the coil spring 73 is regulated. The contact portion 741 of the pressing member 74 includes: a curved portion 742 which is provided in the end portion on the upstream side along the mounting direction (Z direction) of the developing unit 60, and is formed in a curved shape, such as a shape of an arc or an elliptical shape; a flat portion 743 which is linked to the downstream side of the curved portion 742 and is formed in a shape of a substantially horizontal straight line; and a retreating portion 745 which retreats downward via an inclined portion 744 formed to be linked to the downstream side of the flat portion 743.

In addition, when the pressing member 74 is mounted on the holding member 80 on the outer circumference of the pressing member 74, the contact portion 741 is provided at a position at which regulating portions 746 and 747 which perform the regulation to be regulated in the same direction as the mounting direction (Z direction) of the developing unit 60, oppose each other by 180 degrees. The regulating portions 746 and 747 are disposed in the intersecting direction making a predetermined central angle with the contact portion 741 in this orientation. One regulating portion 746 includes a guiding piece 746*a* which is provided in the height direction of the pressing member 74, and a regulating piece 746*b* provided to protrude toward the outer circumference in the radial direction intersecting the guiding piece 746*a*, in a shape having an L-shaped side surface. The other regulating portion 747 includes a guiding piece 747*a* provided in the height direction of the pressing member 74, a regulating piece 747*b* provided to protrude toward the outer circumference in the radial direction intersecting the guiding piece 747*a*, and identification pieces 747*c* and 747*c* which are respectively provided to protrude toward the both sides in the circumferential direction in the base end portion of the guiding piece 747*a*, in a shape having a substantially projected plane. In the insertion hole 721 of the insertion guide member 70, as illustrated in FIG. 17, recessed portions 721*a* and 721*b* having shape of a plane which correspond to the regulating portions 746 and 747 of the pressing member 74, are provided. The opening widths of the recessed portions 721*a* and 721*b* are respectively correspond to the regulating portions 746 and 747 of the pressing member 74.

In addition, in the holding member 80, as illustrated in FIG. 20, at positions which correspond to each coil spring 73, a mounted portion 830 on which the pressing member 74 is mounted is provided. The mounted portions 830 are respectively provided corresponding to each coil spring 73 (Y, M, C, K) of yellow (Y), magenta (M), cyan (C), and black (K) colors. The mounted portion 830 is formed in a triple concentric cylindrical shape being integrally with the reinforcing ribs 802 and 803 or being separated from the reinforcing ribs 802 and 803 on the front surface of the holding member 80. At the center of the mounted portion 830, as illustrated in FIG. 12A, a first cylindrical portion 831 which positions the coil spring 73 and into which a center shaft 748 of the pressing member 74 is inserted is provided to be relatively low. In addition, on the outer side of the first cylindrical portion 831 in the mounted portion 830, a second cylindrical portion 832 into which the outer circumference of the pressing member 74 is inserted and held, is provided in a state of being protruded to be relatively the highest. Furthermore, on the outer circumference of the second cylindrical portion 832 in the mounted portion 830, a third cylindrical portion 833 which is positioned to be inserted into the cylindrical insertion hole 721 of the insertion guide member 70 is provided in a state of protruding to be slightly higher than the first cylindrical portion 831 and to be lower than the second cylindrical portion 832.

In the mounted portion 830, as illustrated in FIG. 20, a regulating portion 834 which regulates the movement in the circumferential direction of the pressing member 74 and positions the contact portion 741 of the pressing member 74 in the attaching and detaching direction of the developing unit 60 by coming into contact with the regulating portions 746 and 747 of the pressing member 74 on the inner circumference of the third cylindrical portion 833, is provided. In the regulating portion 834, the lower end portion is open and the inner portion is formed in the hollow, the regulating portion 834 allows the movement in the vertical direction in a state where the regulating portions 746 and 747 of the pressing member 74 are inserted, and regulates the movement in the circumferential direction. In the regulating portion 834, paths 835 and 836 which allow the insertion of the regulating portions 746 and 747 of the pressing member 74, are respectively disposed at an adjacent position along the counterclockwise direction. The path 835 has the width which corresponds to the regulating portion 746 of the pressing member 74, and the path 836 has the witch which corresponds to the regulating portion 747 of the pressing member 74, respectively. In addition, in the lower end portion of the regulating portion 834, a cutout portion which is not illustrated and communicates with the paths 835 and 836, is provided.

Therefore, as illustrated in FIG. 17, the pressing member 74 is inserted into the insertion hole 721 of the insertion guide member 70 against the biasing force of the coil spring 73, and in a state where the regulating portions 746 and 747 of the pressing member 74 move downward along the paths 835 and 836, as the pressing member 74 rotates in the clockwise direction in the drawing, the regulating portions 746 and 747 of the pressing member 74 move to the inner portion of the regulating portion 834 via the cutout portion which is not illustrated and is provided in the lower end portion of the paths 835 and 836, are raised in the regulating portion 834 by the biasing force of the coil spring 73, and are stopped in a state where the pressing member 74 protrudes only by a necessary amount from the front surface of the insertion guide member 70.

In addition, as described above, a third cylindrical portion 833K which corresponds to the image forming device 10K of black color in the mounted portion 830, configures the positioning portion 811 which performs the positioning in the X direction and in the Z direction when mounting the holding member 80 on the insertion guide member 70.

Figure 28:
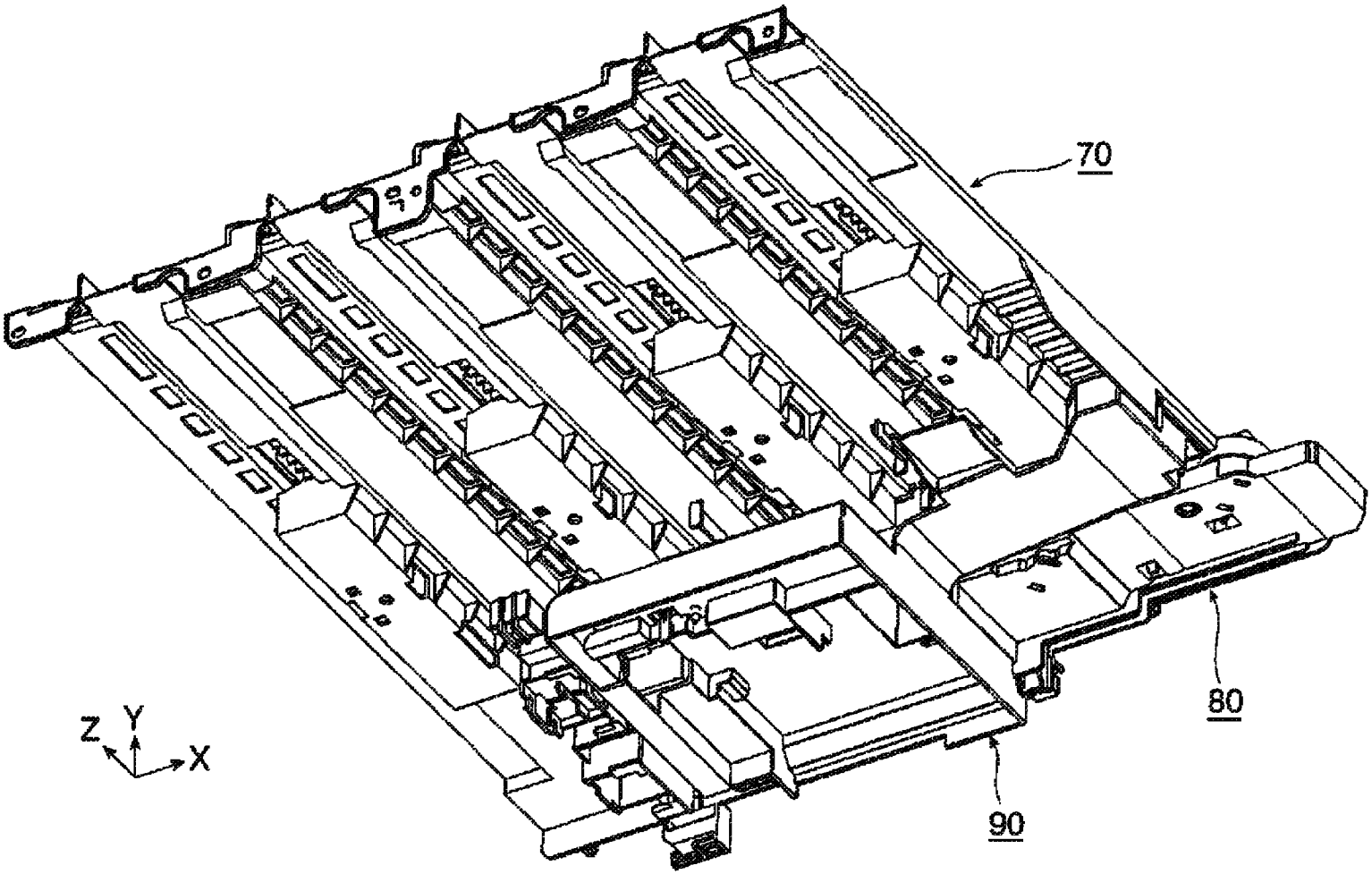
FIG. 28 is a perspective configuration view illustrating a state where the holding member and an air duct member are mounted on the insertion guide member.

In addition, on the back surface of the insertion guide member 70 and the holding member 80, as illustrated in FIG. 28, the air duct member 90 which supplies the air is mounted on the back surface side of each image forming device 10 (Y, M, C, K) of yellow (Y), magenta (M), cyan (C), and black (K) colors. The insertion guide member 70 configures a guiding unit in a state where the holding member 80 and the air duct member 90 are mounted. The air duct member 90 is a member which forms an air duct in which the air flows between the insertion guide member 70 and the holding member 80 by air-tightly covering a part of the back surface of the insertion guide member 70 and the holding member 80. In addition, the lower end surface of the air duct member 90 is blocked by the base frame 109 of the image forming apparatus main body 1*a* and the air duct is formed. In addition, in the base frame 109 of the image forming apparatus main body 1*a*, as illustrated in FIG. 26, a blowing fan 910 which is an example of a blowing unit is provided.

As illustrated in FIG. 28, the air duct member 90 is mounted on the back surface of the insertion guide member 70 in a snap-fit manner similar to the holding member 80. On the back surface of the insertion guide member 70, as illustrated in FIG. 22, four snap-fit portions 741 to 744 are provided to protrude downward in the vertical direction. As illustrated in FIG. 23, the four snap-fit portions 741 to 744 are configured basically similar to the snap-fit portions 731 to 734.

Figure 29:
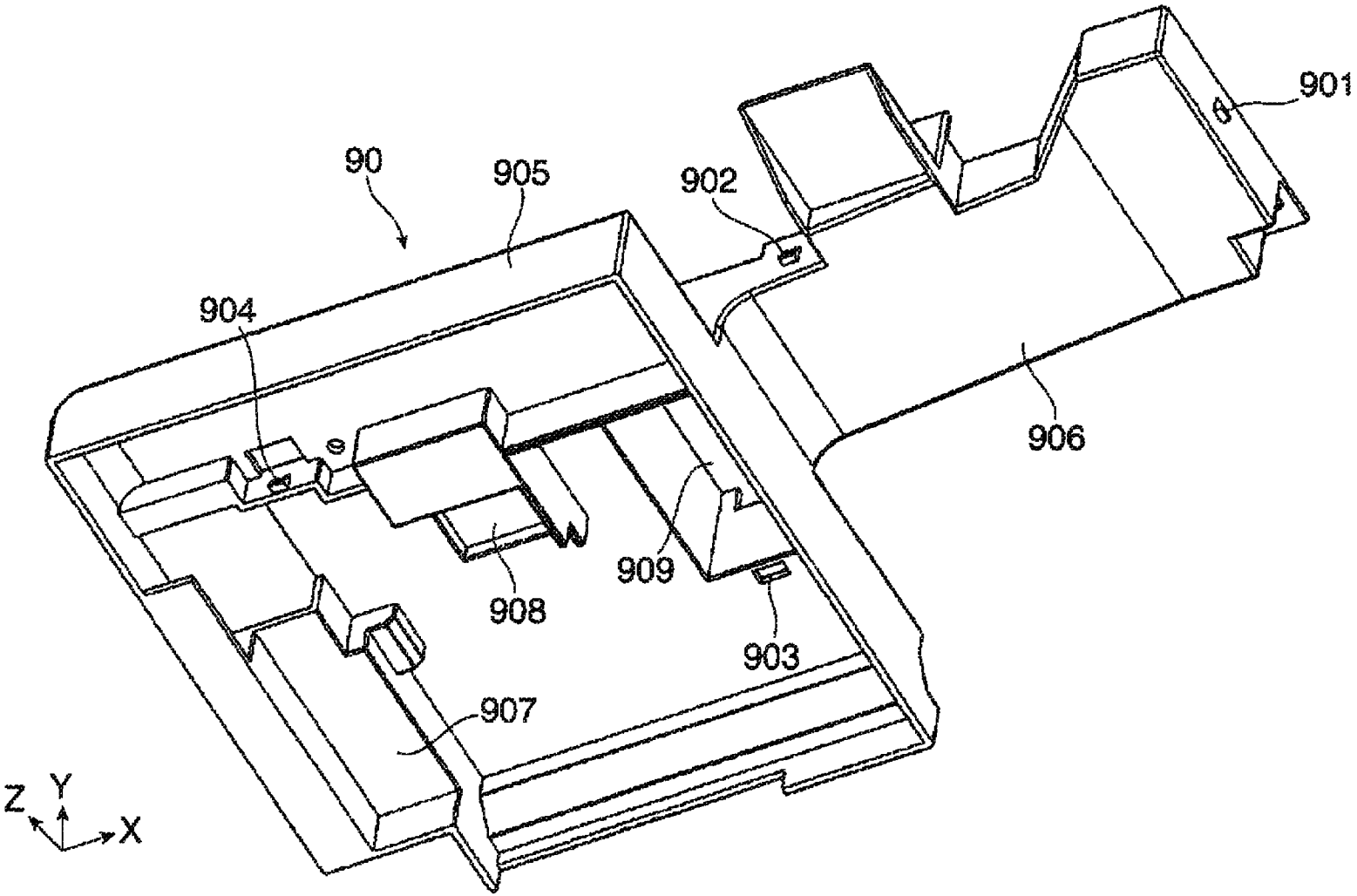
FIG. 29 is a perspective configuration view illustrating the air duct member.
Figure 30:
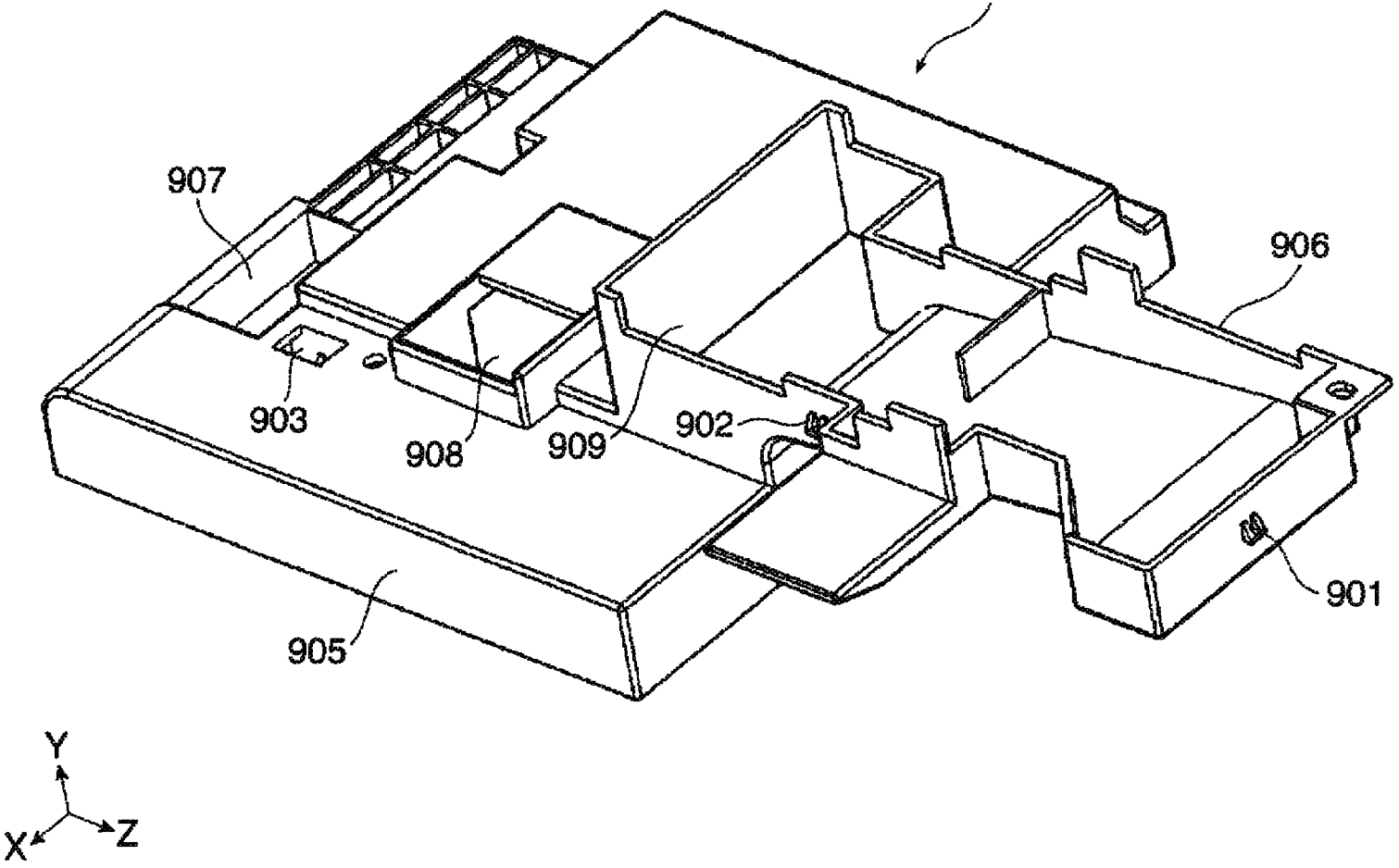
FIG. 30 is a perspective configuration view illustrating the air duct member.

In addition, in the air duct member 90, as illustrated in FIGS. 29 and 30, engaging portions 901 to 904 which correspond to the snap-fit portions 741 to 744 of the insertion guide member 70 are respectively provided. The engaging portions 901 to 904 have a plane which opposes the convex portion 736 of the engaging piece 735 that configures the snap-fit portions 741 to 744. In addition, in a state where the air duct member 90 is mounted on the insertion guide member 70, similar to FIG. 23, a void which is equal to or greater than 1 mm is set to be formed between the convex portion 736 of the engaging piece 735 of the insertion guide member 70 and the end surface of the engaging portions 901 to 904 of the air duct member 90.

As illustrated in FIGS. 29 and 30, the air duct member 90 is provided with a main body portion 905 which is formed on a housing in which the height of a substantially rectangular plane shape is low, and an air introducing portion 906 which is integrally formed in a substantially rectangular shape on one side of the main body portion 905. On one side of the main body portion 905 of the air duct member 90, a blowing port 907 for blowing the air to the image forming device 10K of black (K) color, is open. At the center of the main body portion 905 of the air duct member 90, a blowing port 908 for blowing the air to the image forming device 10C of cyan (C) color is open. Furthermore, on the other side of the main body portion 905 of the air duct member 90, a blowing port 909 for blowing the air to the image forming devices 10M and 10Y of magenta (M) and yellow (Y) colors via the air introducing portion 906, is open.

In addition, in the image forming device 10K of black (K) color, an air flow blown from the blowing port 907 is sent via the duct portion 815 provided in the end portion of the holding member 80.

In the insertion guide member 70, as illustrated in FIG. 17, supply ports 751 (Y, M, C, K) which supply the air flow blown by the air duct member 90 to the back surface side of each image forming device 10 (Y, M, C, K) of yellow (Y), magenta (M), cyan (C), and black (K) colors, are open in each different shape.

As illustrated in FIG. 26, the insertion guide member 70 is attached to the front frame 102 and the rear frame 103 of the image forming apparatus main body 1*a* as described above in a state where the holding member 80 is mounted and the air duct member 90 and the blowing fan 910 are attached and configure the final guiding unit. In other words, the guiding unit finally includes the insertion guide member 70, the holding member 80, the air duct member 90, and the blowing fan 910.

Operation of Characteristic Part of Image Forming Apparatus

Figure 31:
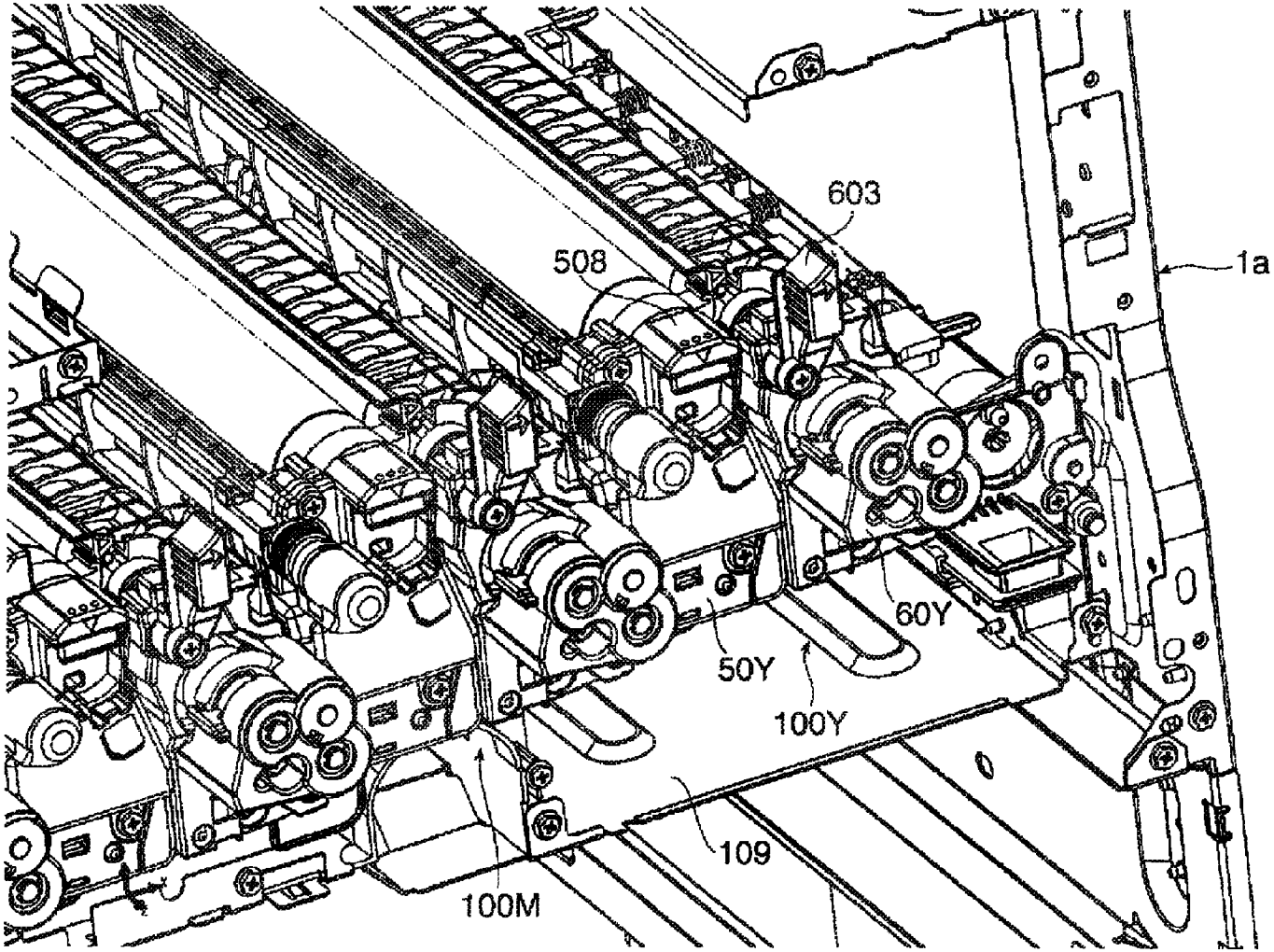
FIG. 31 is a perspective configuration view illustrating a mounted state of a process cartridge of the image forming apparatus according to the first exemplary embodiment of the invention.

In the image forming apparatus 1 according to the first exemplary embodiment, as illustrated in FIG. 31, in a case where the process cartridge 100 (Y, M, C, K) which configures each image forming device 10 (Y, M, C, K) of yellow (Y), magenta (M), cyan (C), and black (K) colors is mounted on the image forming apparatus main body 1*a*, or in a case where at least one process cartridge 100 (Y, M, C, K) is replaced, an operation of attaching and detaching the process cartridge 100 to and from the image forming apparatus main body 1*a* is performed as will be described next.

The photoconductor unit 50, the developing unit 60, and the exposure unit 13 which configure the process cartridge 100, are mounted on the insertion guide member 70 (refer to FIG. 16) of the image forming apparatus main body 1*a*, in a state where a front cover which is not illustrated and is provided on the front surface (a surface which an operator opposes) of the image forming apparatus main body 1*a* is open, as illustrated in FIG. 31. In addition, the photoconductor unit 50, the developing unit 60, and the exposure unit 13 are mounted on the image forming apparatus main body 1*a* in an order of the exposure unit 13, the developing unit 60, and the photoconductor unit 50. In addition, an order of detaching the photoconductor unit 50, the developing unit 60, and the exposure unit 13 from the image forming apparatus main body 1*a* is a reverse order. In addition, in a case where the mounting of the exposure unit 13 is not accompanied, the developing unit 60 and the photoconductor unit 50 are mounted in order, and are detached in a reverse order. The photoconductor unit 50 is simply attachable and detachable, but in a case where the developing unit 60 is attached and detached, the photoconductor unit 50 is also attached and detached at the same time.

Figure 32:
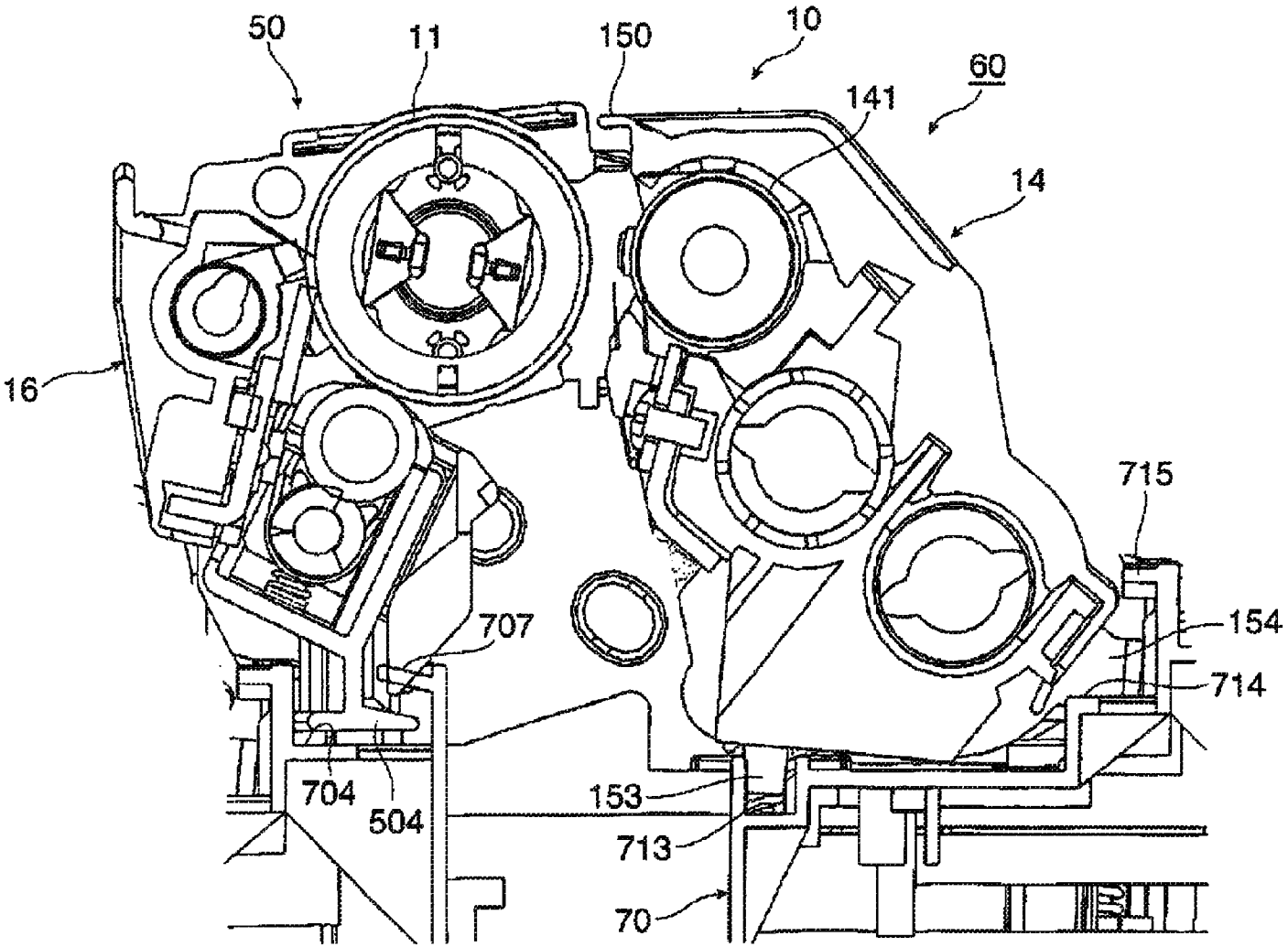
FIG. 32 is a sectional configuration view illustrating a state where a developing device of the image forming apparatus according to the first exemplary embodiment of the invention is separated from the photoconductor unit.

As illustrated in FIG. 31, the developing unit 60 rotates the switching lever 603 of the holder member 601 in the clockwise direction, and moves the developing device 14 to the retreat position. Next, as illustrated in FIG. 32, the developing unit 60 inserts the first convex portion 153 of the developing device housing 140 into the guide groove 713 of the insertion guide member 70, loads the second convex portion 154 of the developing device housing 140 on the guiding surface 714 of the insertion guide member 70, and is mounted as being inserted toward the far side of the image forming apparatus main body 1*a*.

When the developing unit 60 is mounted at the predetermined position of the image forming apparatus main body 1*a*, the positioning hole 146 provided in the end portion on the far side along the mounting direction of the developing unit 60 is inserted into the second stud 113 provided in the rear frame of the image forming apparatus main body 1*a*, and as illustrated in FIG. 3, the positioning holes 609 and 610 of the holder member 601 of the developing unit 60 are positioned as being inserted into the positioning projections 607 and 608 of the image forming apparatus main body 1*a*. However, in the state, the developing device 14 of the developing unit 60 is positioned not at the operation position but at the retreat position. At this time, the developing unit 60 becomes a state where the switching lever 603 rotates in the clockwise direction.

Figure 12B:
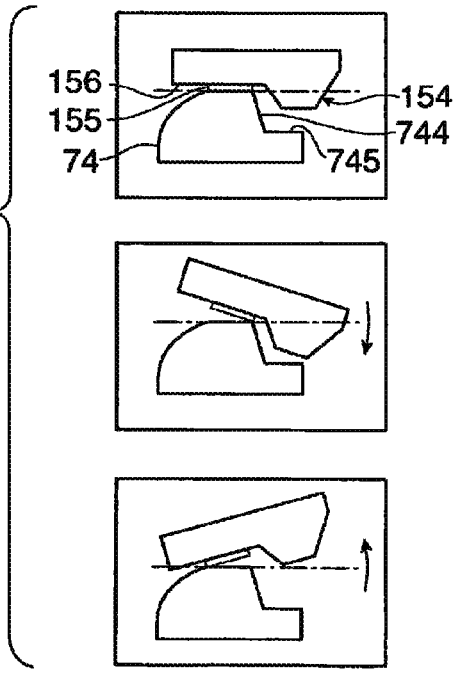
FIG. 12B is a schematic diagram illustrating actions of the main portions.
Figure 33:
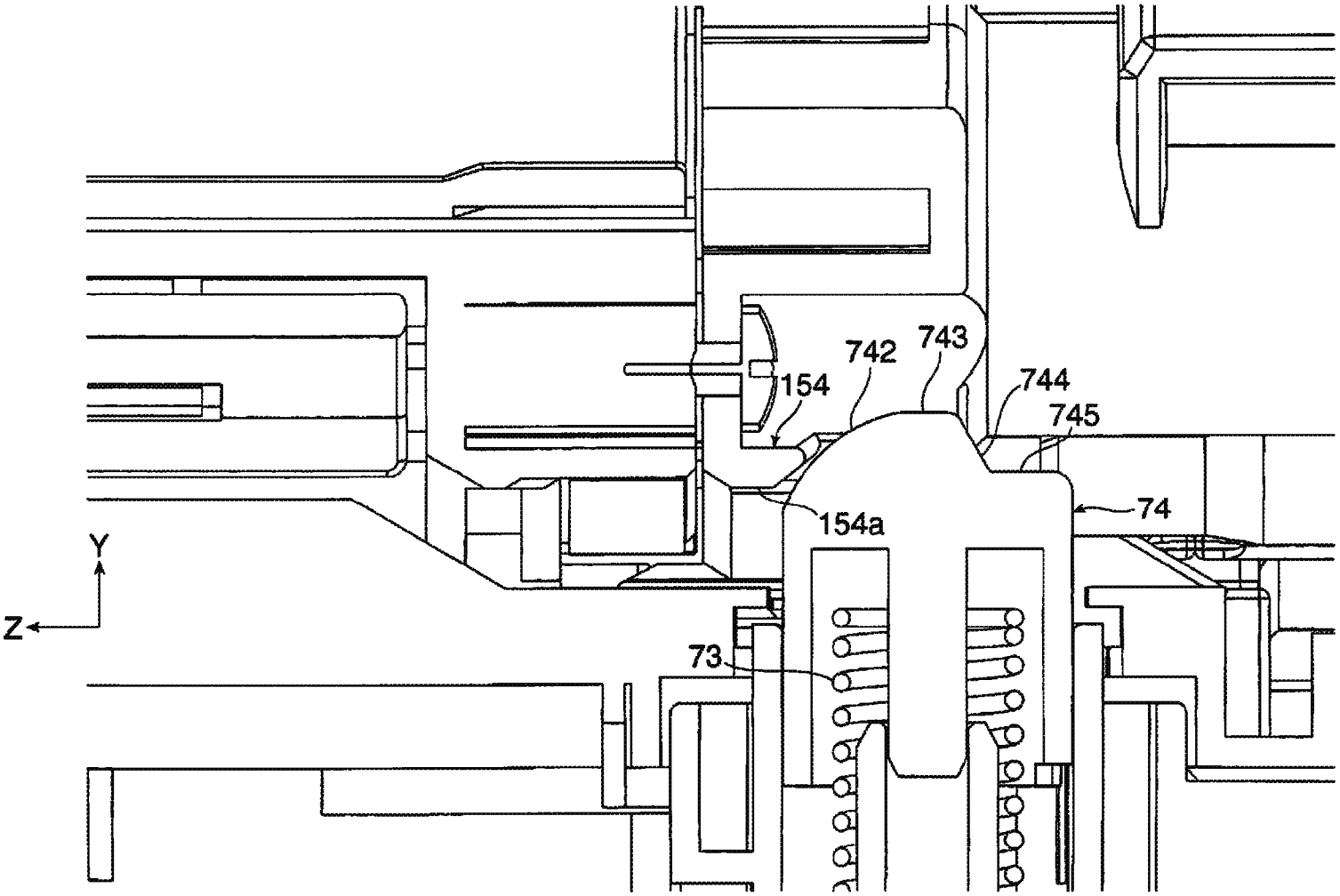
FIG. 33 is a sectional configuration view illustrating the main portions of the image forming apparatus according to the first exemplary embodiment of the invention.
Figure 34:
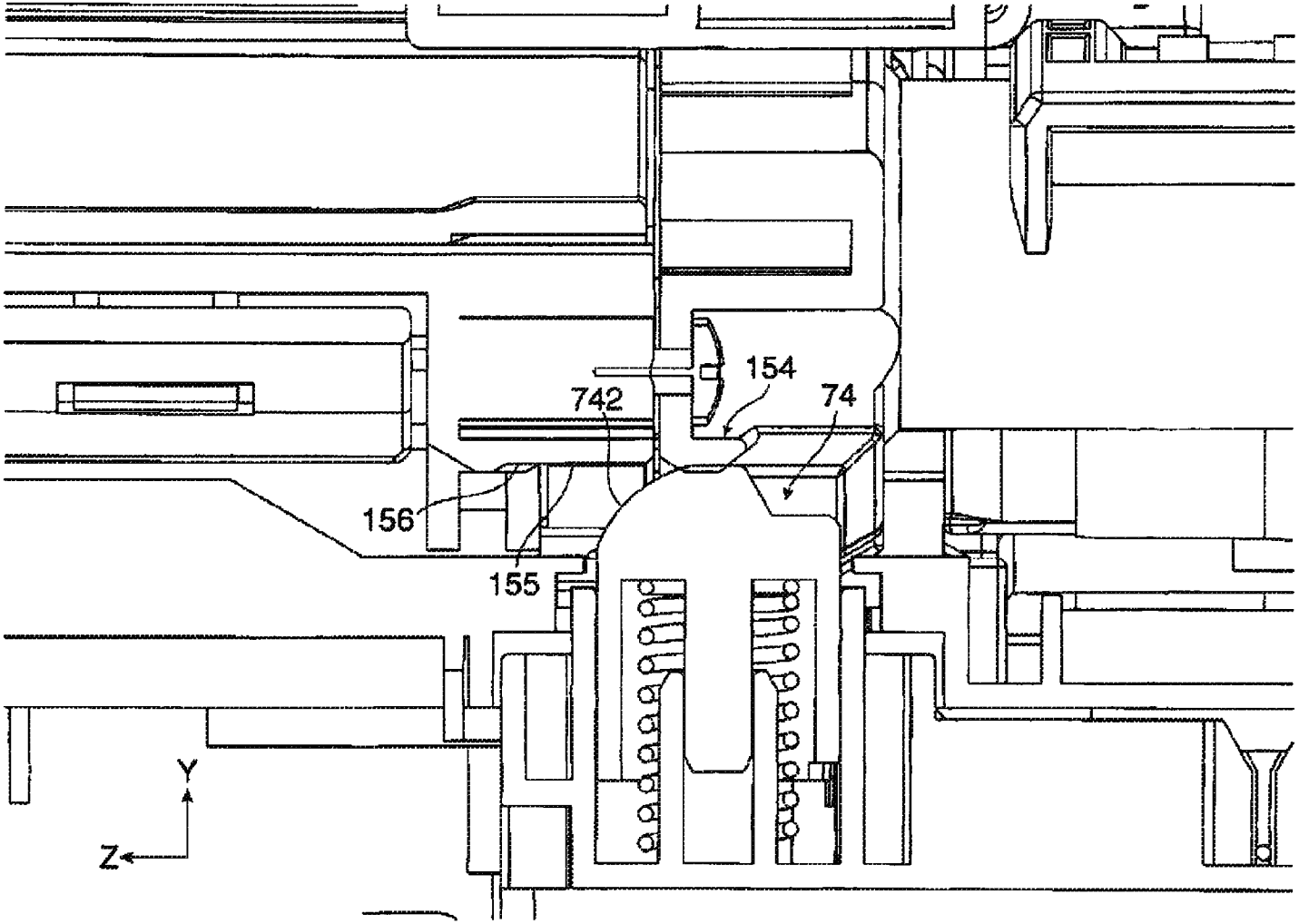
FIG. 34 is a sectional configuration view illustrating the main portions of the image forming apparatus according to the first exemplary embodiment of the invention.

At this time, as illustrated in FIG. 33, when the second convex portion 154 of the developing device housing 140 moves to the far side of the image forming apparatus main body 1*a* along the guiding surface 714 of the insertion guide member 70, the second convex portion 154 comes into contact with the pressing member 74 mounted on the insertion guide member 70. Since the curved portion 742 is provided in the end portion on the near side along the mounting direction of the developing device housing 140 of the pressing member 74, as illustrated in FIG. 34, the pressing member 74 is pressed down by the second convex portion 154 of the developing device housing 140 via the curved portion 742. After this, as illustrated in FIG. 12A, the pressing member 74 is displaced upward by the biasing force of the coil spring 73 after passing through the second convex portion 154 of the developing device housing 140, and is stopped in a state of being in contact with the electrode 155 of the electrode attaching portion 156 provided on the near side along the mounting direction of the second convex portion 154. The stop position of the developing unit 60 is a position at which the holder member 601 of the developing unit 60 abuts against the front surface side of the image forming apparatus main body 1*a*. Since the recessed portion 745 is provided in the pressing member 74, in a state where the developing unit 60 is stopped, it is avoided that the second convex portion 154 comes into contact with the part other than the flat portion 743 of the pressing member 74. In addition, even when the developing unit 60 is inclined, as illustrated in FIG. 12B, since the second convex portion 154 does not come into contact with the part other than the flat portion 743 of the pressing member 74, the pressing member 74 and the electrode 155 reliably come into contact with each other.

In addition, when the developing unit 60 is detached from the image forming apparatus main body 1*a*, as the inclined portion 744 of the pressing member 74 comes into contact with the inclined surface 154*b* of the second convex portion 154, the pressing member 74 is pressed downward.

At the time of the mounting, the pressing member 74 is pressed to the electrode 155 of the developing unit 60 by the biasing force of the coil spring 73, and the developing bias becomes a conducted state via the pressing member 74 to the developing device 14. In addition, the holding member 80 on which the coil spring 73 that biasing the pressing member 74 is mounted, receives the pressing force as the reaction force by the biasing force of the coil spring 73. In the holding member 80, as illustrated in FIG. 25, the end portion on yellow side is directly supported to be in contact with the intermediate frame 111 of the image forming apparatus main body 1*a*, regions of magenta and cyan colors are supported to be in contact with the base frame 109 of the image forming apparatus main body 1*a* via the air duct member 90, and the region 814 of black color is directly supported to be in contact with the base frame 109 of the image forming apparatus main body 1*a*. Therefore, it is possible to prevent the holding member 80 from being moving downward or deformed to be bent even in a case of receiving the pressing force by the coil spring 73, and to make the biasing force of the coil spring 73 reliably act on the developing unit 60.

In addition, after the pressing member 74 is pressed down by the second convex portion 154 of the developing device housing 140 since the pressing member 74 is in contact with the electrode 155 of the developing unit 60 in a state of moving from below to above, the force along the attaching and detaching direction of the developing unit 60 is prevented from being acted on the electrode 155.

In addition, in the image forming apparatus main body 1*a*, the photoconductor unit 50 is mounted after the developing unit 60 is mounted. As illustrated in FIG. 32, the photoconductor unit 50 is mounted as being pressed toward the far side of the image forming apparatus main body 1*a* in a state where the guide portion 504 provided in the lower end portion of the photoconductor unit 50 is inserted into the photoconductor unit guide 704 of the insertion guide member 70. When the photoconductor unit 50 is mounted at the predetermined position of the image forming apparatus main body 1*a*, the cylindrical positioning portion 513 provided in the end portion on the far side along the mounting direction of the photoconductor unit 50 is inserted into the first stud 112 provided in the rear frame 103 of the image forming apparatus main body 1*a*, the positioning projection 505 of the front frame portion 502 of the photoconductor unit 50 is positioned at the operation position as being inserted into the positioning hole 506 of the image forming apparatus main body 1*a*, and the positioning projection 505 is fixed by the fixing unit which is not illustrated.

When the photoconductor unit 50 is guided by the insertion guide member 70 and mounted on the image forming apparatus main body 1*a*, as the projection portion 515 of the photoconductor unit 50 abuts against the guide rail portion 150 of the developing unit 60, as illustrated in FIG. 32, a necessary void is formed between the photoconductor unit 50 and the developing unit 60, and the front surface of the photoconductor drum 11 is prevented from being in contact with the developing unit 60 and damaged.

As described above, in a state where the photoconductor unit 50 is fixed to be positioned at the operation position of the image forming apparatus main body 1*a*, by rotating the switching lever 603 of the holder member 601 in the counterclockwise direction, the developing unit 60 rotates to the photoconductor drum 11 side around the second stud 113 and the rotating shaft 602, and moves to the operation position, as the end portion on the near side of the housing 140 of the developing device 14 along the mounting direction is pressed by the coil spring 606, and the end portion on the far side of the housing 140 of the developing device 14 along the mounting direction is pressed by the coil spring 73 via the pressing member 74. In the developing unit 60, as the abutting members 152 provided in both end portions along the shaft direction of the developing roll 141 abut against the abutting member 516 of the photoconductor drum 11 by the biasing force of the coil springs 606 and 73, the void (drum to roll space (DRS)) between the photoconductor drum 11 and the developing roll 141 is held to be a necessary value.

In addition, when the photoconductor unit and the developing unit are detached from the image forming apparatus main body 1*a*, the operation reverse to that of the time of the mounting is performed.

In this manner, in the exemplary embodiment, compared to a case where the holding member 80 which holds the coil spring 73 that biasing the developing device 14 toward the photoconductor drum 11 is not in contact with the image forming apparatus main body 1*a* directly or via another member, deterioration of the biasing force of the coil spring 73 which acts on the back surface side of the developing device 14 is prevented. Therefore, in the developing unit 60, the void (drum to roll space (DRS)) between the photoconductor drum 11 and the developing roll 141 is held to be a necessary value.

In addition, in the present exemplary embodiment, since the biasing unit 72 which biases the developing device 14 toward the photoconductor drum 11 serves as an applying unit which applies the developing bias voltage to the developing device 14, compared to a case where the biasing unit and the applying unit are separately configured, the number of components is reduced and the cost is reduced.

In addition, in the exemplary embodiment, the full-color image forming apparatus which forms the toner images of four colors, such as yellow (Y), magenta (M), cyan (C), and black (K) is described as the image forming apparatus, but it is needless to say that the exemplary embodiment can be similarly employed in monochromatic image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holder that holds an electrostatic latent image;

a developing unit that develops the electrostatic latent image of the image holder;

a biasing unit that biases the developing unit toward the image holder; and a holding member that holds the biasing unit, wherein the biasing unit includes a pressing member made of a conductive material that is in contact with the developing unit and presses the developing unit, and wherein a surface of the holding member at a side opposite the pressing member is in contact with the image forming apparatus, wherein the pressing member is in contact with an electrode provided in the developing unit and applies developing bias voltage to the developing unit, wherein an end portion of the pressing member which is in contact with the developing unit is provided with a curved portion and a recessed portion, wherein the curved portion is disposed on an upstream side along a mounting direction of the developing unit and the curved portion protrudes in a shape curved toward the developing unit, and wherein the recessed portion is disposed downstream of the curved portion along the mounting direction of the developing unit and the recessed portion is recessed in a direction away from the developing unit.

2. The image forming apparatus according to claim 1, further comprising:

a guide member that guides the image holder and the developing unit, wherein the holding member is attached to the guide member in a state where the holding member is positioned along an attaching and detaching direction of the image holder and the developing unit with respect to the guide member and along a direction orthogonal to the attaching and detaching direction.

3. The image forming apparatus according to claim 1, further comprising:

a guide member that guides the image holder and the developing unit to the image forming apparatus main body detachably, wherein the holding member is attached to the guide member in a state where the holding member is movable along a vertical direction with respect to the guide member.

4. The image forming apparatus according to claim 2, wherein the biasing unit biases the developing unit through an insertion hole provided in the guide member.

5. The image forming apparatus according to claim 2, wherein a projection portion configured to be elastically deformable is engaged so as to mount the holding member on the guide member.

6. The image forming apparatus according to claim 2, wherein the holding member is mounted on the image forming apparatus main body and is provided integrally with the guide member.

7. The image forming apparatus according to claim 6, further comprising an air duct provided integrally with the guide member.

8. The image forming apparatus according to claim 1, wherein the biasing unit includes an biasing member made of a metal wire that biases the developing unit.

9. The image forming apparatus according to claim 8, wherein the biasing member integrally forms a power supply electric path to supply the developing bias voltage.

10. The image forming apparatus according to claim 1, wherein the developing unit is provided with a convex portion disposed downstream of a contact portion which is in contact with the pressing member along the mounting direction of the developing unit, wherein the convex portion protrudes in a direction away from the developing unit.

11. The image forming apparatus according to claim 1, wherein the end portion of the pressing member which is in contact with the developing unit is provided with a flat portion, wherein the flat portion is in contact with the electrode of the developing unit.

12. An image forming apparatus comprising:

an image holder that holds an electrostatic latent image;

a developing unit that develops the electrostatic latent image of the image holder;

a biasing unit that biases the developing unit toward the image holder; and a holding member that holds the biasing unit, wherein the biasing unit includes a pressing member made of a conductive material that is in contact with the developing unit and presses the developing unit, and wherein a surface of the holding member at a side opposite the pressing member is in contact with the image forming apparatus, wherein the pressing member is in contact with an electrode provided in the developing unit and applies developing bias voltage to the developing unit, wherein an end portion of the pressing member which is in contact with the developing unit is provided with a curved portion and an inclined portion, wherein the curved portion is disposed on an upstream side along a mounting direction of the developing unit and the curved portion protrudes in a shape curved toward the developing unit, and wherein the inclined portion is disposed downstream of the curved portion along the mounting direction of the developing unit and the inclined portion is inclined along a direction away from the developing unit.

13. An image forming apparatus comprising:

an image holder that holds an electrostatic latent image;

a developing unit that develops the electrostatic latent image of the image holder;

a biasing unit that biases the developing unit toward the image holder; and a holding member that holds the biasing unit and is disposed so that a part of the holding member which holds an end, in an opposite direction to a biasing direction of the biasing unit, of the biasing unit, is in contact with an image forming apparatus main body directly or via another member, wherein the biasing unit includes a pressing member made of a conductive material that is in contact with the developing unit and presses the developing unit, wherein the pressing member is in contact with an electrode provided in the developing unit and applies developing bias voltage to the developing unit, wherein the pressing member has a contact portion that has a flat plate shape and protrudes toward the electrode, wherein the pressing member has a regulating portion that regulates a rotation of the pressing member, and wherein the regulating portion is a plate-shaped portion that protrudes outwardly in a direction substantially perpendicular to the biasing direction.

* * * * *